US005386669A

United States Patent [19]

Almeida

[11] Patent Number: 5,386,669

[45] Date of Patent: Feb. 7, 1995

[54] CORROSION RESISTANT LEAKPROOF PLASTIC MANHOLE SYSTEM

[76] Inventor: Antonio V. Almeida, 18927 Fortson, Dallas, Tex. 75252

[21] Appl. No.: 31,340

[22] Filed: Mar. 15, 1993

[51] Int. Cl.[6] ..... E02D 29/14

[52] U.S. Cl. ..... 52/19; 220/415; 220/429; 220/468

[58] Field of Search ..... 52/199, 28–100, 52/19–21; 220/415, 430, 431, 4.26, 4.31, 429, 468; 137/363–367

[56] References Cited

U.S. PATENT DOCUMENTS

| | | | |
|---|---|---|---|
| 1,639,495 | 8/1927 | Frame | 52/20 |
| 1,712,510 | 5/1929 | Monie | 52/20 |
| 3,269,421 | 8/1966 | Telford et al. | 138/97 |
| 3,312,262 | 4/1967 | Hunter | 220/414 |
| 3,729,165 | 4/1973 | Trimble | 249/144 |
| 3,745,738 | 7/1973 | Singer | 52/741 |
| 3,807,110 | 4/1974 | Kaminski | 52/100 |
| 3,834,433 | 9/1974 | Thompson | 141/392 |
| 4,212,415 | 7/1980 | Neely | 220/4.26 |
| 4,245,970 | 1/1981 | St. Onge | 425/13 |
| 4,325,772 | 4/1982 | Suetoshi et al. | 156/294 |
| 4,350,548 | 9/1982 | Zenbayashi et al. | 156/156 |
| 4,386,628 | 6/1983 | Stanley | 138/97 |
| 4,456,401 | 6/1984 | Williams | 405/150 |
| 4,563,847 | 1/1986 | Hasty | 52/199 |
| 4,601,312 | 7/1986 | Parkyn, Sr. | 138/97 |
| 4,602,659 | 7/1986 | Parkyn, Sr. | 138/98 |
| 4,678,370 | 7/1987 | Allen | 405/154 |
| 4,728,223 | 3/1988 | Rice | 405/154 |
| 4,751,799 | 6/1988 | Ditcher et al. | 52/21 |
| 4,796,669 | 1/1989 | St. Onge | 138/97 |
| 4,818,314 | 4/1989 | Brittain et al. | 156/87 |
| 4,846,147 | 7/1989 | Townsend et al. | 126/307 |
| 4,957,389 | 9/1990 | Neathery | 404/72 |
| 4,995,584 | 2/1991 | Trimble | 249/10 |
| 4,997,602 | 3/1991 | Trimble | 264/32 |
| 5,002,438 | 3/1991 | Strong | 405/303 |
| 5,017,313 | 5/1991 | Trimble | 264/32 |
| 5,032,197 | 7/1991 | Trimble | 156/71 |
| 5,081,802 | 1/1992 | Westhoff et al. | 52/20 |
| 5,182,885 | 2/1993 | Barton | 52/98 |

FOREIGN PATENT DOCUMENTS

| | | | |
|---|---|---|---|
| 2555284 | 5/1985 | France | 52/20 |

OTHER PUBLICATIONS

International Publication WO 91/00399 dated 10 Jan. 1991, 6 pages dwgs., 18 pages speci.

*Primary Examiner*—James L. Ridgill, Jr.
*Attorney, Agent, or Firm*—Stephen D. Caner; Trent C. Keisling

[57] ABSTRACT

A leakproof modular manhole system comprising a plurality of separate cooperating, plastic form units that snap fit together in a vertical stack. The deployed system provides a complete replacement for an existing manhole, or forms an entirely new corrosion resistant and leakproof manhole. Each of the seamless units is preferably rotationally molded from polyethylene plastic. Each double walled unit interiorly defines a material receptive annular cavity. The cavity may be filled with structural or non structural fill material. A generally tubular base unit is disposed at the bottom of the excavation for connection with the sewer line by an eccentric reducer coupling. A concrete invert is formed in the base in fluid flow communication with the sewer line. One or more tubular riser units extend serially upwardly from the base. The risers are available in varying lengths to accommodate different manhole depths. The system corbel is formed by a cone that structurally terminates alongside the pavement. Preferably the base, the risers, and the cone snap fit together. A segmented extender extends from the cone to a manhole frame. It adjusts the length of the system to raise the relative grade of the top if grade alterations are made near the manhole. The installed system is leakproof and corrosion resistant, and it encapsulates the invert at the manhole bottom to further isolate the manhole from surrounding ground water.

6 Claims, 16 Drawing Sheets

CORROSION RESISTANT LEAKPROOF PLASTIC MANHOLE SYSTEM

BACKGROUND OF THE INVENTION

1. Field of the Invention

The present invention relates generally to manhole structures, and to the construction or replacement of manholes. More particularly, the present invention relates to plastic, corrosion resistant, leakproof components for manhole repair or assembly. Art pertinent to the present invention may be found in U.S. Class 52, Subclasses 20 and 71; Class 156, Subclass 71; and Class 264, Subclass 32.

2. Discussion of the Prior Art

Modern sewage systems are overloaded. The factors contributing to this overload include the growth of our cities, the inevitable aging of sewer systems, and the poor quality associated with installation of new systems. The deterioration of associated manholes is a major cause for alarm. It has been mandated by the Environmental Protection Agency that cities must stop the flow of sewage into streams, lakes, rivers and oceans.

Modern, sanitary sewer systems comprise of a variety of interconnected lines, pumping stations, conduits and the like. Municipal sewers typically comprise a plurality of networked, generally horizontally extending underground lines that are generally, but not always, adjacent and beneath the street network. These sewers include horizontal, subterranean lines formed of longitudinally aligned sections of slightly inclined pipes, that terminate periodically within manholes. A manhole is essentially a vertical passageway, typically beginning at ground level at or near the street surface, that extends downwardly into the ground. Typically a manhole receives one or more sewer line junctions. Eventually the sanitary sewer lines run to a sewage treatment facility, so that the waste may be properly processed. Storm sewer lines, on the other hand, may be discharged directly into rivers and streams.

Manholes enable human access to line junctions and installations for system inspections, maintenance and repairs. Typical manholes are formed through various construction techniques of bricks, tiles or concrete blocks bonded together with cement mortar. Pre-cast and "cast in place" concrete manholes are also common.

While it will be recognized that numerous problems are associated with conventional sewer systems, water seepage through conventional manhole structures is a primary cause of system overloading. Inflow and infiltration through conventional manholes cause flooding of the sanitary sewer system and overloading of "downstream" treatment plants. As a result, raw sewage can be discharged directly into the environment by way of the drainage system, much of which is above ground. Such inflow and infiltration will increase the flow in the system as much as ten times in some instances. An increase of three to four times is not uncommon. Studies have shown that as much as seventy-five percent of the inflow during rainy periods occurs through defects in the manholes. The remaining twenty-five percent occurs through the transport lines between each manhole. Of course exfiltration through leaking manholes is dangerous as well.

The deterioration associated with older brick and mortar manholes is obvious. Concrete manholes allow infiltration and/or exfiltration as a result of honeycombing, cold joints, or improperly sealed joints. Unstable ground promotes cracking and deterioration, so concrete manholes installed in earthquake-prone areas are particularly vulnerable.

Conventional concrete manhole assemblies typically experience significant interior corrosion and deterioration with age. This deterioration occurs even where acidic effluents, known to be harmful to sewers and sewer treatment systems, are prohibited from entering or are first dissipated or neutralized. Hydrogen sulfide is inherent in sewage. It is developed due to the presence of sulfur compounds, such as sulfate, sulfite, or other inorganic or organic sulfur. The above-mentioned compounds are reduced to sulfide by sulfate-reducing bacteria normally found in the effluent. The generation of hydrogen sulfide is accelerated in the presence of moderate temperatures and low flow rates.

The useful life of concrete is determined by dividing the available effective thickness of the concrete by the corrosion rate. The corrosion rate can be calculated when all factors are known. The effective thickness of the concrete is the amount covering the steel reinforcement typically embedded within the manhole assembly.

Coatings have been applied to manhole interiors, but they have a poor track record. For example, although coal tar, or epoxy provides effective protection against hydrogen sulfide, such coatings have provided poor field performance due application difficulties. However, it is recognized in the industry that coatings are not the same as "linings." Cementitious linings may be sprayed on in place as disclosed in U.S. Pat. No. 5,002,438 issued to Strong on Mar. 26, 1991.

It is also known to insert a pre-formed structural liner inside an existing manhole. The liner must conform to the configuration of existing manhole as closely as possible, and it must usually be custom designed and made. Other means of rehabilitating include the use of a sleeve or cylinder disposed within the manhole that forms an annulus between itself and the existing brick structure. The annulus is filled with grout to form a lining. However, since the confines of the manhole are extremely irregular, the temporary liner is difficult to properly configure, and the operation is haphazard and unreliable at best.

Previously, linings of plastic material have provided excellent performance for interior corrosion protection against hydrogen sulfide and sulfuric acid. Such plastic linings are further compatible with plastic pipe now being used extensively in sanitary systems. However, to date, it is extremely difficult to fabricate interior linings and integrate such interior linings into manhole assemblies. Flexible type linings are presently used in pipes to protect the upper portions attacked by sulfurous compounds. Integrating known plastic tubular liner sections within the existing concrete structure has proven difficult. Known prior art assemblies lack suitable structural strength, and they present additional problems in handling and assembly. In addition, the linear seams are difficult to seal. Further, these seams have been found to degrade, resulting in leaks through the manhole structure.

The prior art reflects numerous patents that teach the relining or repair of sewer conduits with add-on, sleeve-like liners. U.S. Pat. No. 4,796,669 Issued to St. Onge, Jan. 10, 1989 discloses a method for relining buried pipeline by coaxially inserting interconnected plastic sections of tubing within the pipeline. These sections are glued together until the entire pipeline has been relined. U.S. Pat. No. 4,245,970, issued Jan. 20, 1981, also discloses plastic structure for relining a sewer pipe. Britain, patent No. 4,818,314 issued Apr. 4, 1989 discloses a similar system including a plurality of liner segments for relining pipelines. U.S. Pat. No. 4,846,147 issued Jul, 11, 1989 discloses a chimney liner system wherein a sleeve formed from a fiberglass cloth is inserted interiorly to reline the chimney.

U.S. Pat. No. 4,456,401 issued Jun. 26, 1984 employs a felt liner impregnated with a liquid resin material inserted within the sewer line for repair. U.S. Pat. No. 4,386,628 Issued Jun. 7, 1983 teaches the maintenance lining passageways by inserting into it a flexible tubular material of a lower diameter. The tubular material is a laminate having an outer contiguous layer of a composition foamable to form an expanded cellular structure. The pipe is expanded and solidifies in place within the pipe.

Another popular method is to provide a segmented series of pipes or liner sections inserted into the pipe to be repaired. An annulus results between the pipe and the "liner," and grout or cementitious material may be pumped into the annulus to form an interior lining. U.S. Pat. No. 4,751,799 issued Jun. 21, 1988 employs liners comprising a plurality of individual liner sections to define the inner surface of the manhole member to be "relined." The resultant annulus thereafter receives grout. U.S. Pat. No. 4,728,223, issued Mar. 1, 1988; U.S. Pat. No. 4,602,659, Issued to Parkyn Jul. 29, 1986, Parkyn patent No. 4,601,312 issued Jul. 22, 1986, and U.S. Pat. No. 4,350,548 issued Sep. 21, 1982 all depict systems in that a resultant annulus is filled with grout.

U.S. Pat. No. 4,325,772 issued Apr. 20, 1982, shows the use of a flexible liner tube within an installed pipe. A liquid adhesive agent is forced into the annulus formed therebetween. Allen patent No. 4,678,370 issued Jul. 7, 1987 discloses a system of helically wound internal liners that define an annulus within the sewer pipe for receiving cementitious grout. A related invention is seen in Telford patent No. 3,269,421 issued Aug. 30, 1966. U.S. Pat. No. 3,834,433 issued to Larson on Sep. 10, 1974 discloses a sewer repair apparatus adapted to be moved within a pipe and centered upon a leaking area. Ends of the apparatus thereafter expand to form a seal, centered over the leaking pipe area. Subsequent pressurization of this area forces grout outwardly through the annulus, through the ends of the pipe, and forms an internal and external cover for patching the leak.

Other patents disclose various methods to cast a manhole in place. For example, U.S. Pat. No. 4,995,584 shows how form structure may be installed in place at the manhole for subsequent application of cementitious material to the annulus. However, the panels therein disclosed are difficult to use and they are complex. U.S. Pat. Nos. 4,997,602, 3,729,165 and 5,017,313 are similar.

Trimble, U.S. Pat. No. 5,032,197 uses removable and temporary protective plastic liner molds to form a liner for a manhole. Cementitious materials are applied within the annulus.

Neathery patent No. 4,957,389, issued Sep. 18, 1990, also discloses a seal type structure that is disposed within the manhole to define an annulus. Concrete is poured in the annulus between the form base and the chimney wall to seal the structure.

Singer, U.S. Pat. No. 3,745,738 discloses a corrosion resistant manhole. It is formed by placing concrete about a plastic liner within a form. The form is removed but the plastic liner is left in place to protect the interior of the newly formed manhole.

Also pertinent to the present invention is U.S. Pat. No. 5,081,802, issued Jan. 21, 1992 to Westhoff. It discloses a liner assembly formed from a plurality of flanges that enables the pouring of grout or cementitious materials in the annulus.

It is desirous to provide for the complete replacement of an existing manhole, or the construction of a new manhole, with a system capable of being precast or cast in place that preserves leak-proof integrity. Ideally such a manhole system should be modular, seamless, flexible, leakproof, and corrosion resistant. Each modular section should have an outside and an inside wall separated by a cavity that can be filled with structural or non structural fill material to create a manhole section. It would also be advantageous to adapt these sections to be stacked vertically through a reliable, leak proof system.

Such a modular manhole system must be capable of field customizing to conform to structural and weight requirements of the application, while maintaining required physical dimensions. The system structural cavity must be easily filled in the field to meet custom strength applications. Thus the manhole must be capable of "cast in place" installation. Alternatively, the manhole system must meet construction industry "precast" standards. And, when cavities are prefilled with material prior to shipment, the manhole units must not collapse or deform.

SUMMARY OF THE INVENTION

My corrosion resistant leakproof plastic manhole system provides a complete replacement for an existing manhole. Alternatively one or more portions of the system may be used to construct a new manhole. My system facilitates the erection of a noncorroding, leakproof manhole in a desired excavation that readily interconnects with the sewer lines. Portions of the present system may be precast and then placed in an excavation for the new manhole.

The system is modular, comprising a plurality of individual, stackable units. The units are constructed of seamless polyethylene plastic. Each is double-walled, interiorly defining a material receptive cavity. The cavity may be filled with structural or non structural fill material. The units are vertically stacked, preferably employing a system of spigot and bell joints sealed by gaskets.

The units comprising the manhole system include a base unit supporting a cone unit. One or more riser units may be disposed between the cone and base as necessary. The base is connected to existing or newly installed sewer lines by an eccentric reducer. Extenders are employed to raise the relative grade of the top of the system if repaving or other grade alterations are made near the manhole.

Structural fill material used to fill the cavity in the units can be cement, small aggregate concrete, cellular concrete, grout, plastic foam, or the like. The cavity can also contain preformed reinforcing steel wire to add to the structural integrity of the modular units. This reinforcing steel would be contained within the double walled cavity. Nonstructural material such as sand, gravel, or recycled materials may add mass to the system. Cavity fill material is placed or pumped into the cavities through holes cut or drilled in the upper or outer portion of each of the units, which are plugged after the cavity is filled.

The base unit rests in the bottom of a manhole excavation. It is generally cylindrically shaped with an open top and a floor. The cavity is formed between inner and outer walls and inner and outer seamless floors. The upper portion of the unit is shaped to provide a "spigot" joint. The spigot mates with a "bell" formed in a riser or cone. The spigot comprises an outwardly projecting ring and an upwardly projecting lip.

One or more tubular riser units maybe disposed upon the base. Each riser unit comprises an inner and outer seamless shell like the base unit. The risers employ structural ribs for rigidity to prevent torsional flex. The bottom portion of the risers defines a bell intended to captivate an upwardly projecting spigot. The bell comprises an outwardly projecting, inverted ledge defined in the inner wall and a downwardly projecting brim. A circular gasket secures the joint between the spigot and the bell. The upper portion of a riser defines a spigot similar to the one described above. The riser's spigot mates with the lower bell of another riser or a bell in the skirt of a cone. This joint is also sealed by a gasket.

The cone unit preferably comprises an inner and outer seamless shell like the other units. The cone is truncated, and the bell is formed in the lower portion. The bell comprises an outwardly projecting inverted ledge and downwardly projecting brim, similar to the riser bell. The spigot of the unit directly below is received within the bell. A gasket is captivated between the spigot and bell to seal the joint. A generally circular tapered opening is established by an inwardly projecting shelf shaped in the upper portion of the cone. The opening receives an extender or manhole cover frame.

The extender is segmented and generally tubular. It comprises a corrugated outer wall that may be readily cut by the installer to an appropriate length. Its lower portion mates with the opening in the cone. The extender raises the manhole frame associated with the present system. This may be necessary due to repaving over the manhole. An O-ring is located in a channel in the tapered base of the extender to provide a leakproof seal. Brick and mortar will be applied around the extender in compliance with local building codes. The brick and mortar structure is partially supported by the cone's shelf. The upper open end of the extender mounts the manhole frame.

The tubular, eccentric reducers preferably comprise a central body and eccentric segments. A hole is cut through the walls of the base to receive the body portion. The segments have varying diameters to mate with various sizes of sewer pipe. However the segments are aligned to provide a smooth bottom. Each eccentric segment has a ridge to aid attaching a flexible pipe coupling. The coupling comprises a rubber sleeve with circular clamps on each end. A cutting groove is defined between the rib and the edge of the eccentric segment to match the diameter of the connecting sewer pipe. The groove also facilitates subsequent field removal of those reducer segments that are smaller than needed.

A preferred method of sealing the reducer in place calls for cutting a hole smaller than the outer diameter of the eccentric reducer's body in the base. The area around the hole is heated, softening the plastic. The reducer is inserted into the heated hole from inside the base. Filling the cavity defined between the walls of the base with cement, concrete or the like will help complete the seal. A sealing ring or gasket may also be placed around the body of the reducer. Polyethylene welding is preferable in establishing the necessary seal.

Therefore, a primary object of the present invention is to provide a Plastic Manhole Lining and Relining System that is corrosion resistant and leak resistant.

A related object of the present invention is to provide a manhole system constructed of corrosion resistant parts that can be quickly assembled in the field.

Another object of my invention is to provide a leakproof modular manhole system that is substantially more resistant to exfiltration and infiltration than conventional concrete manholes.

A further related object of the present invention is to provide an economical and reliable modular manhole system that can be efficiently produced, for example, through rotational molding techniques.

An object of the present invention is to provide a double walled, seamless manhole exhibiting stability and uniformity.

Another important object is to provide a modular manhole system that may be custom assembled at the job site to adapt itself for installations of varying depth.

Another important object is to provide a modular manhole system of the character described that will not crack or leak in response to moderate shifting forces experienced by the ground.

A related object is to provide a manhole system exhibiting maximum flexibility.

Still another object is to provide a manhole system that may be produced with varying thicknesses (i.e., of the double walls) as structurally necessary without changing the overall outside dimensions of the units.

Another object of the present invention is to provide a double walled manhole capable of being assembled in the field.

Another object of my manhole system is to provide a seamless, double walled manhole comprising an internal cavity that may optionally be filled with a variety of reinforcing materials as desired by the contractor.

A related object of the present invention is to provide a seamless double walled manhole that may be filled with cement based products, recycled products, plastic foams or resins.

An object of the present invention is to provide a manhole that may be either pre-cast or cast in place.

An object of the present invention is to provide a manhole system that may be manufactured in a variety of colors.

Another primary object is to provide seamless circular double wall plastic shells that form inner and outer structural walls separated by a filled structural cavity that, when assembled, form a leakproof circular manhole.

Another object is to provide a modular manhole system of the character described that may enclose a reinforcement cage within the cavity of the double wall to meet structural demands.

An object of the present invention is to provide a manhole system that minimizes the number of seals, seams and joints.

Another object of the present invention is to provide a manhole constructed of a series of seamless, circular double wall units that can be assembled in a variety of configurations to readily adapt the system for varying applications.

An object of my invention is to provide bell and spigot joints for a multi-piece manhole system that will establish water-tight structural connections.

A further object of the present invention is to provide a manhole with an outside, waterproof barrier to handle hydrostatic loading occurring in manholes constructed under the ground water table.

An object of the present invention is to provide a manhole that is more resistant to erosion and abrasion than typical conventional concrete manholes.

A still further object is to provide a manhole system that isolates the sewer invert from the surrounding water table. It is a feature of my system that the resultant concrete invert is encapsulated and isolated within a double walled plastic base.

Another object is to provide a manhole exhibiting the qualities of composite construction.

An object of the present invention is to provide a manhole constructed of a series of units employing a resilient profile gasket to maintain a watertight seal.

Another fundamental object of the present invention is to provide a manhole replacement system.

A further object is to provide a modular manhole system that can be made with enclosed reinforcement (i.e., "rebar") within the cavity of the manhole components. The latter feature is facilitated by the rotational molding process. Such reinforcement meets high strength needs in deep installations.

Another object is to provide a modular manhole system that avoids limitations arising from depth specifications.

Yet another object is to provide an electrically nonconductive manhole structure for the electric power and telecommunication industries.

A still further object is to provide a manhole system that can be hand carried to a job site, without using major construction lifting equipment.

Another object is to provide a system that can withstand high hydrostatic loading created by installation in high water table locations in wetlands, marshes, and water bearing soils.

Another fundamental object is to provide a manhole system that is absolutely water tight, unlike any other manhole system, and to do so without coatings or liners on the inside or outside of the structure.

A related object is to absolutely prohibit manhole contamination of the water table, and infiltration or exfiltration.

Another important object is to insure that the manhole system is locked in place during the placement of backfill soil to minimize any settlement or upward movements of the manhole.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
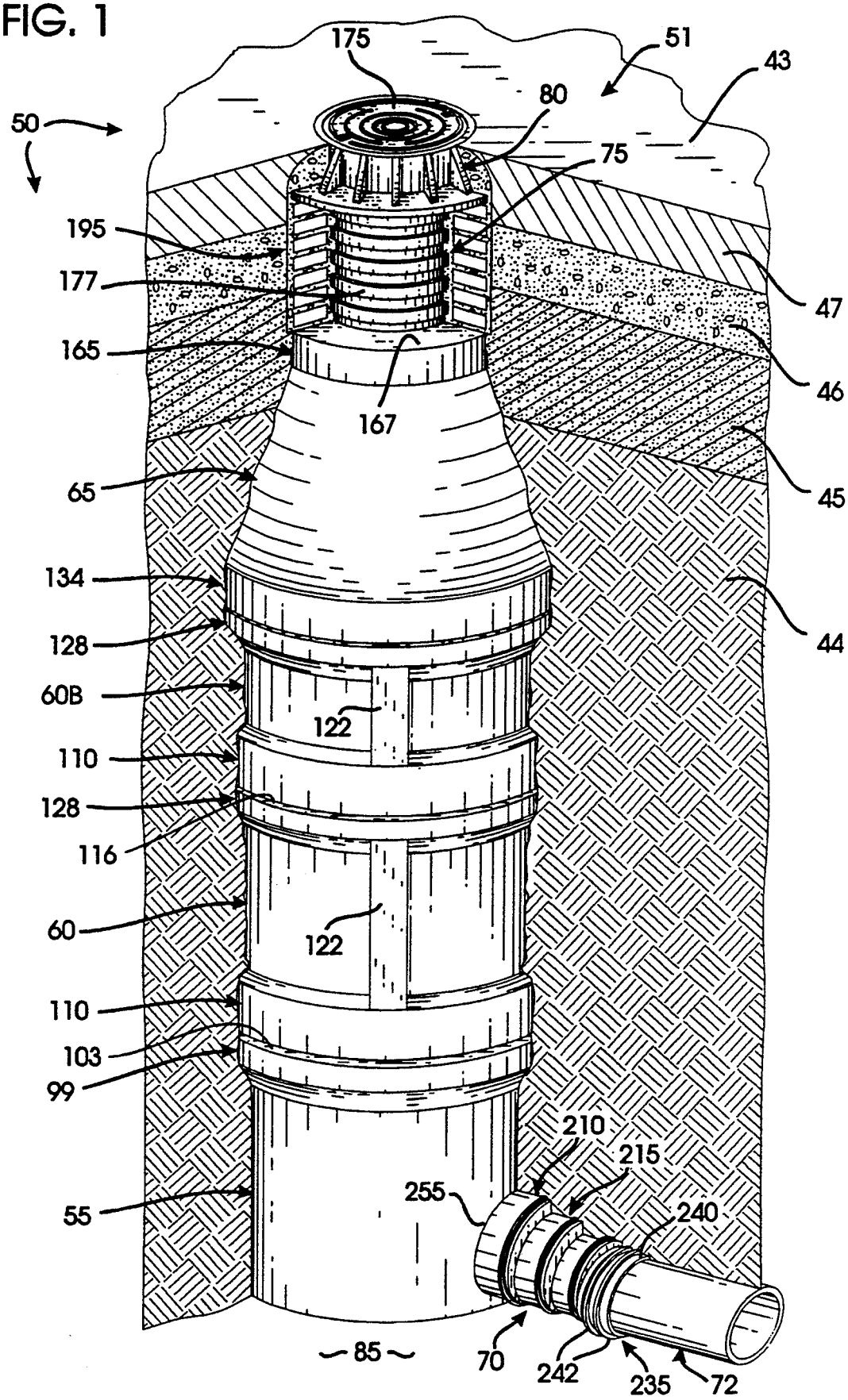
FIG. 1 is a fragmentary, isometric environmental view of the herein disclosed Corrosion Resistant Plastic Manhole System, illustrating the system connected to a sewer line.
Figure 2:
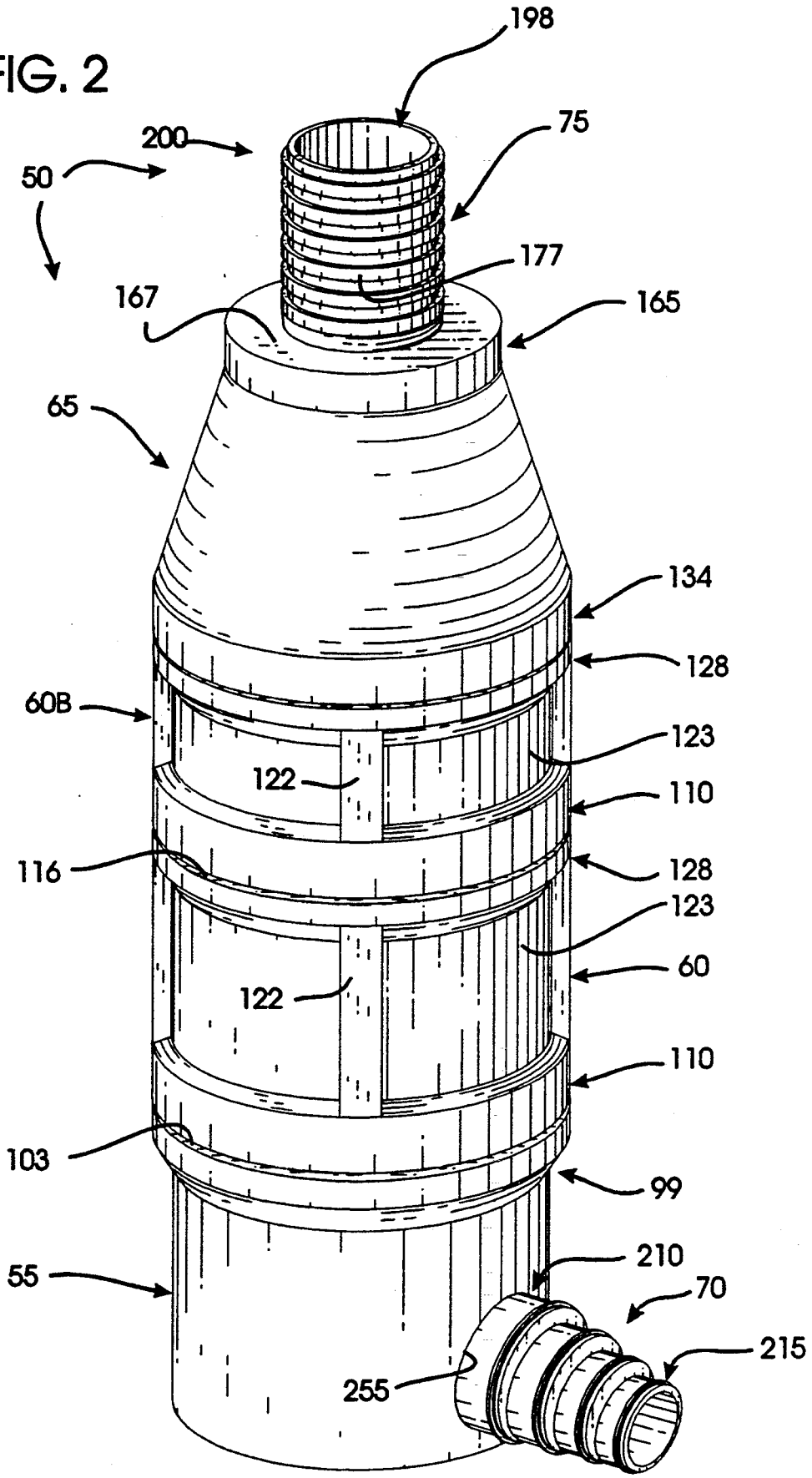
FIG. 2 is an isometric view of the best mode of the system.
Figure 3:
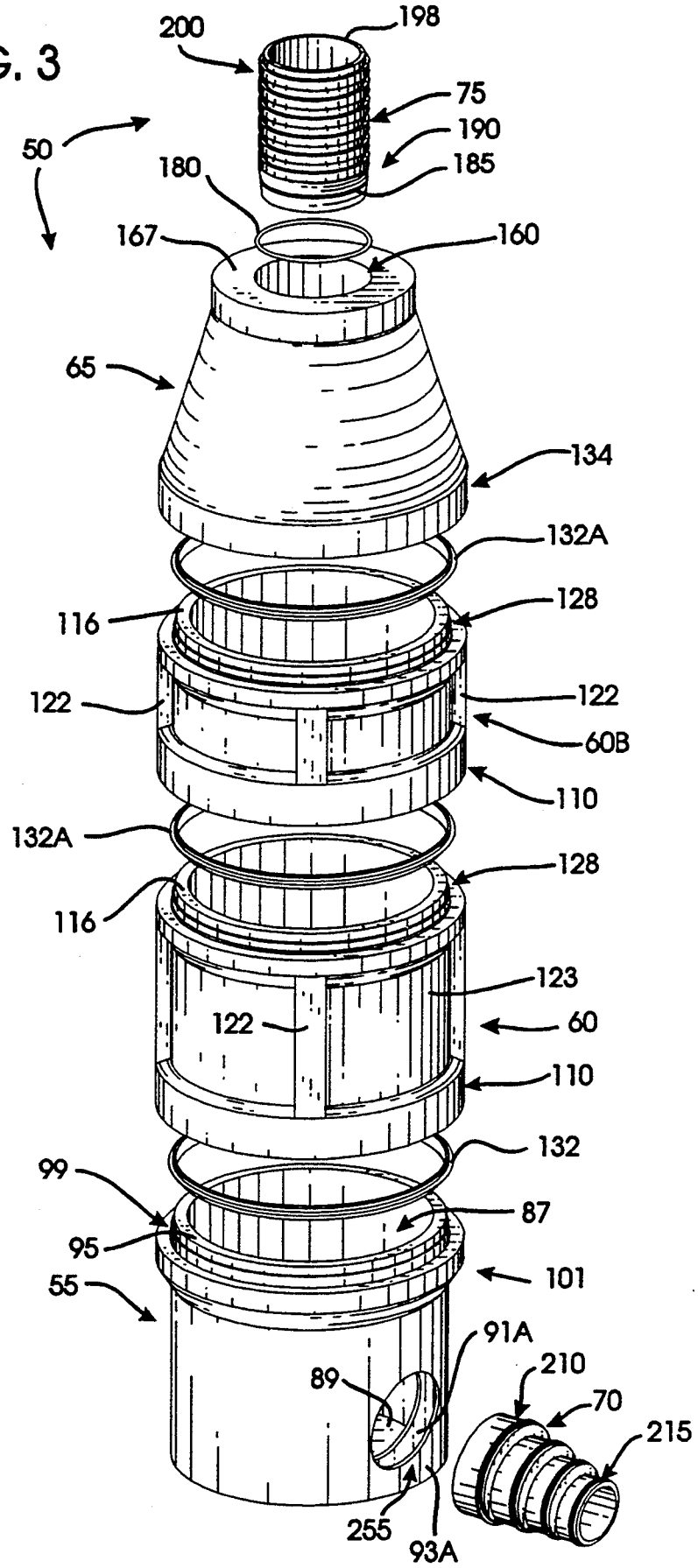
FIG. 3 is an exploded isometric view of the present system.

With initial attention directed to FIGS. 1-3 of the accompanying drawings, the best mode of the herein disclosed manhole system is generally designated by the reference numeral 50. My modular system 50 is ideal where a preexisting concrete manhole must be excavated and replaced, or it may be used as an original manhole in a new or refurbished sewer system. The manhole system 50 can be custom assembled at a desired job site 51, wherein a selected number of its individual, independent units can be snap fitted together to function together harmoniously while custom adapting the system to the desired application. Further, the contractor can custom select desired structural properties without changing the dimensions or assembly technique of the system.

System 50 is installed in the ground 44 (FIG. 1) and roadbed 43. Base 55 is disposed in the bottom floor 85 of the excavation and anchors the system. The system extends vertically upwardly through ground 44, compacted sand and gravel layer 45, subgrade 46, and surface pavement 47. While roadbed 43 may of course vary in construction from that illustrated, system 50 can be easily customized to fit the application. After system 50 is assembled, the individual units are left in place (i.e., they are not removed), unlike conventional form systems. However, the resulting corrosion resistant structure duplicates one function of forms, in that it inherently allows for concrete filling both internally (in its cavities) and externally (around and against its external walls) to provide lateral and subjacent support to the ground 44 and roadbed 43.

In the best mode system 50 comprises a base unit 55, one or more cooperating riser units 60, an upper cone unit 65, and various accessories. The risers and cones extend through the subterranean ground 44, while the cone 65 enters the compacted sand and gravel layer 45. The cone unit 65 forms the corbel of the manhole system 50 while the riser units 60 and base unit 55 together form a stable, generally vertical structure of substantially uniform diameter. A reducer coupling, generally indicated by the reference numeral 70, connects the system's base 55 to existing or newly installed sewer lines 72. Extenders 75 to be described in detail hereinafter are employed to adapt for grade variations in pavement 45 at the top of the excavation; the extender forms a transition between the cone and the road layers 45–47. By varying extender length, as explained below, system 50 facilitates repavement or other grade alterations in the surface. A conventional manhole frame 80 mated to the cone unit 65 via the extender 75 is captivated during pavement surfacing within resilient pavement 47.

Preferably the cone 65, the riser 60, and the base 55 are seamless and double walled. Preferably they are rotationally molded from a corrosion-resistant material such as a polyethylene resin plastic. The cavity between the walls of the units may be filled with structural or nonstructural fill material. They allow the user to obtain a variety of strength and weight combinations. Structural fill material such as cement or concrete 82 (FIGS. 34, 35) may be pumped in through a hole drilled in the upper portion of each of the units. Nonstructural ballast material such as sand or gravel can further weight the units to facilitate their use in a particular application.

Figure 4:
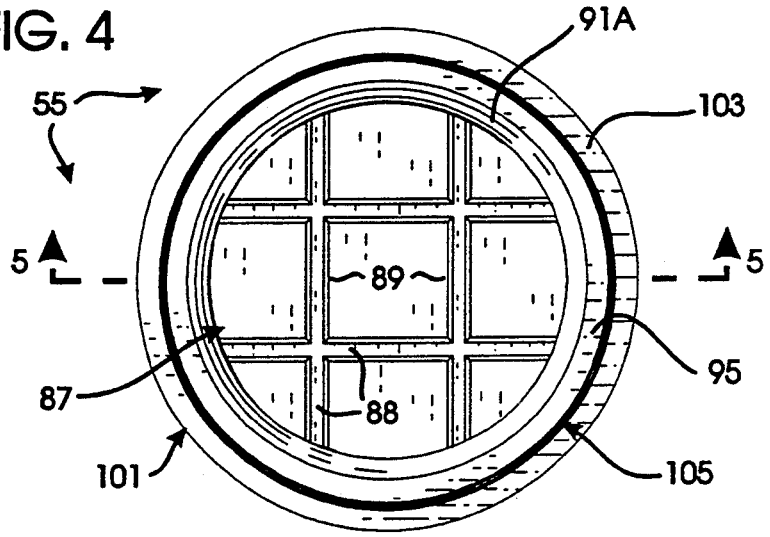
FIG. 4 is a top plan view of a preferred base.
Figure 5:
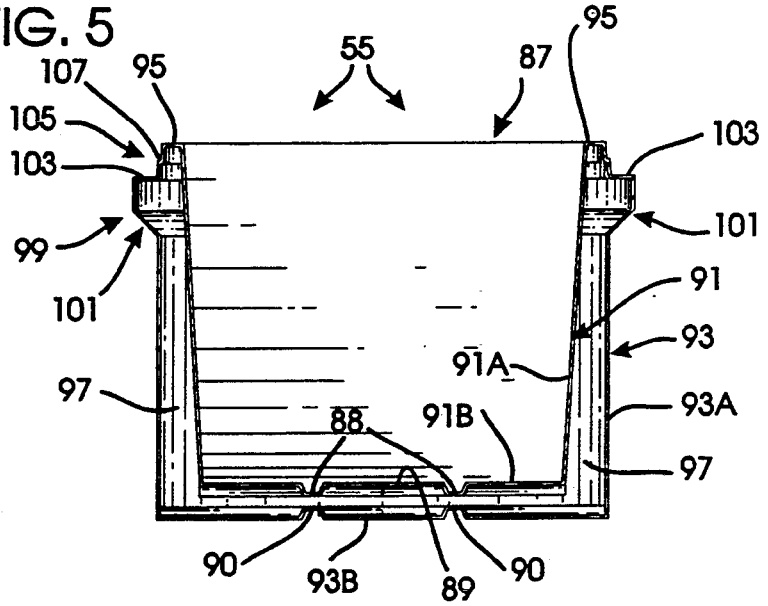
FIG. 5 is a sectional view of the base taken generally along line 5—5 of FIG. 4.
Figure 6:
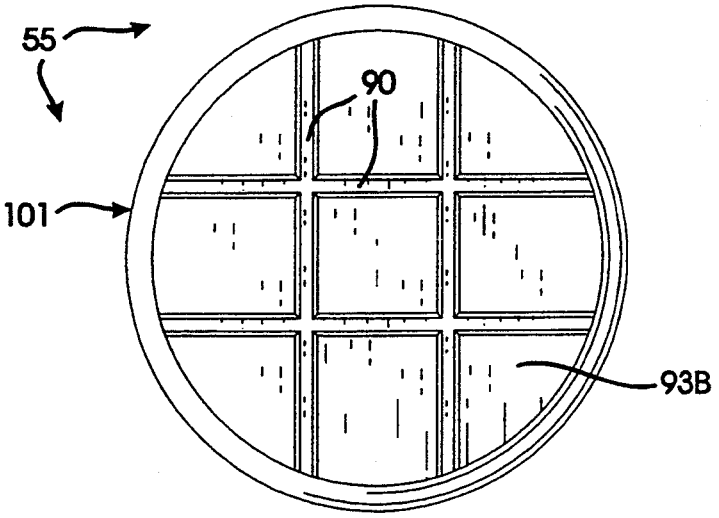
FIG. 6 is a bottom plan view of the base.
Figure 7:
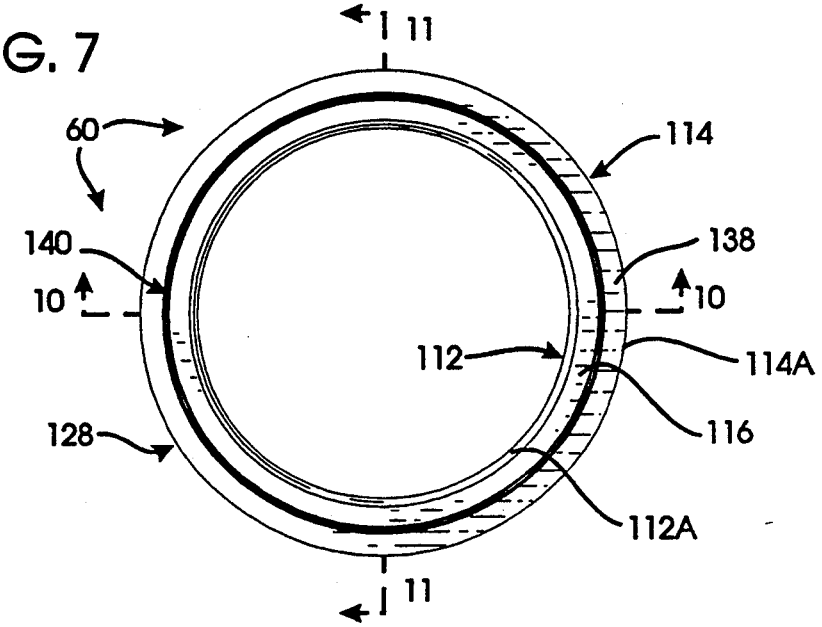
FIG. 7 is a top plan view of a preferred riser.
Figure 8:
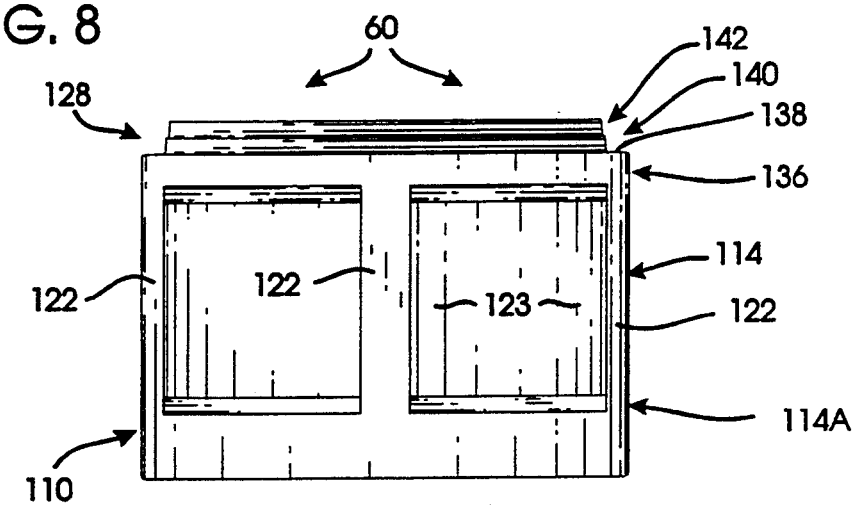
FIG. 8 is a side elevational view of the preferred riser.
Figure 9:
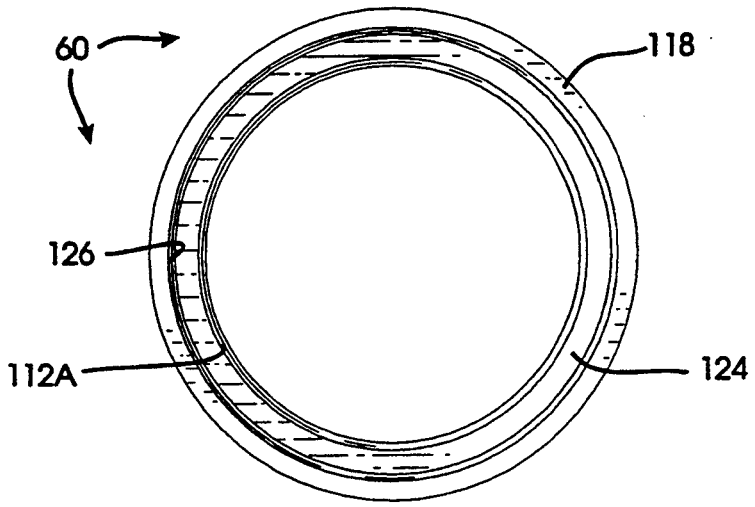
FIG. 9 is a bottom plan view of a riser.
Figure 10:
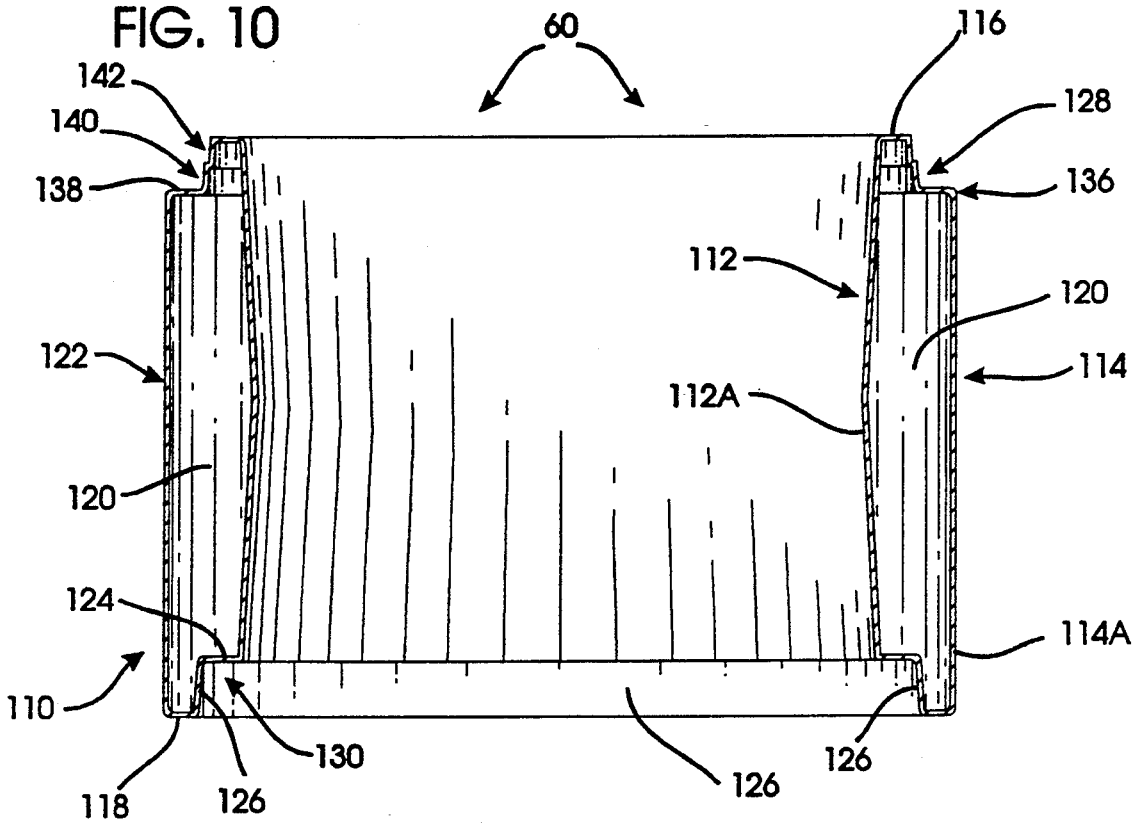
FIG. 10 is an enlarged sectional view of a riser taken generally along line 10—10 of FIG. 7, illustrating the structure of the ribs.
Figure 11:
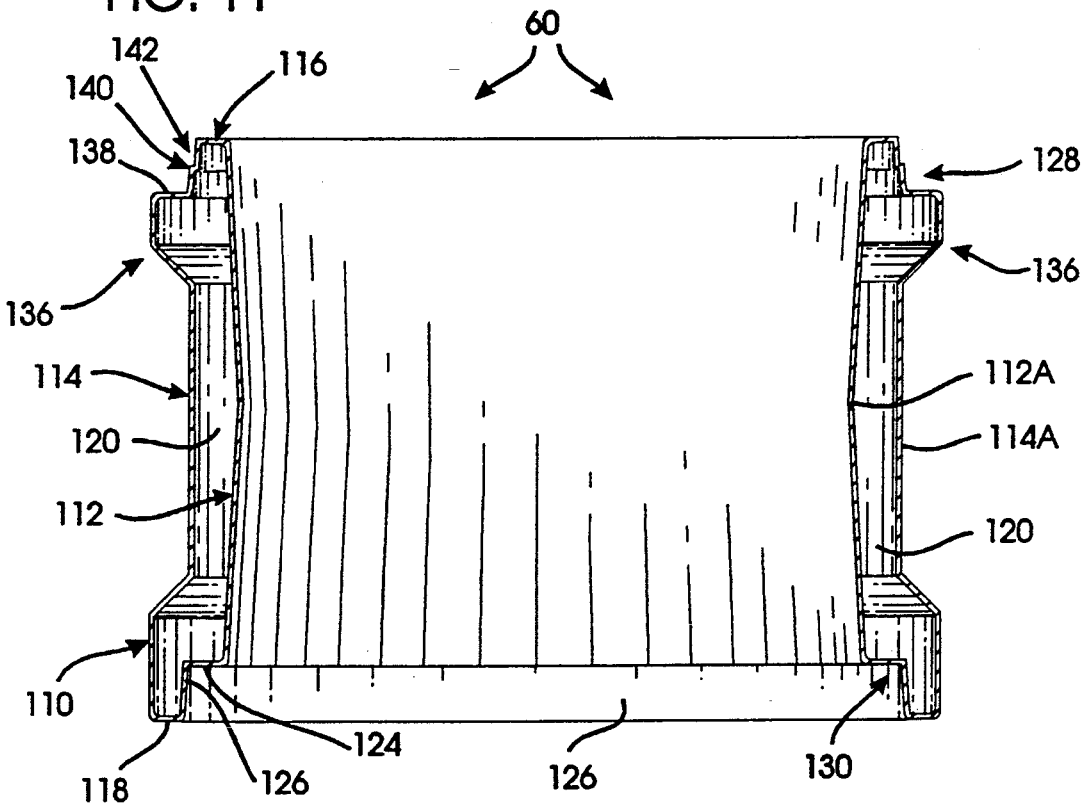
FIG. 11 is an enlarged sectional view of a riser taken generally along line 11—11 of FIG. 7 illustrating the wall structure between ribs.
Figure 12:
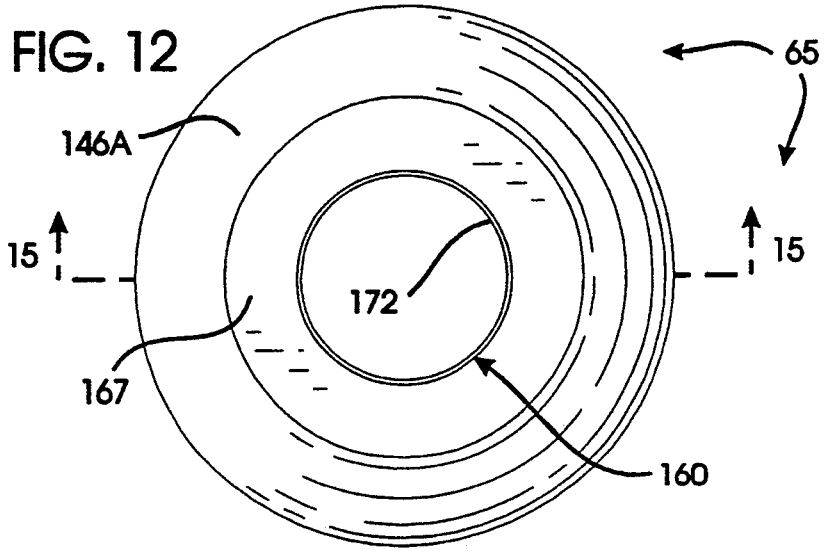
FIG. 12 is a top plan view of a preferred cone.
Figure 13:
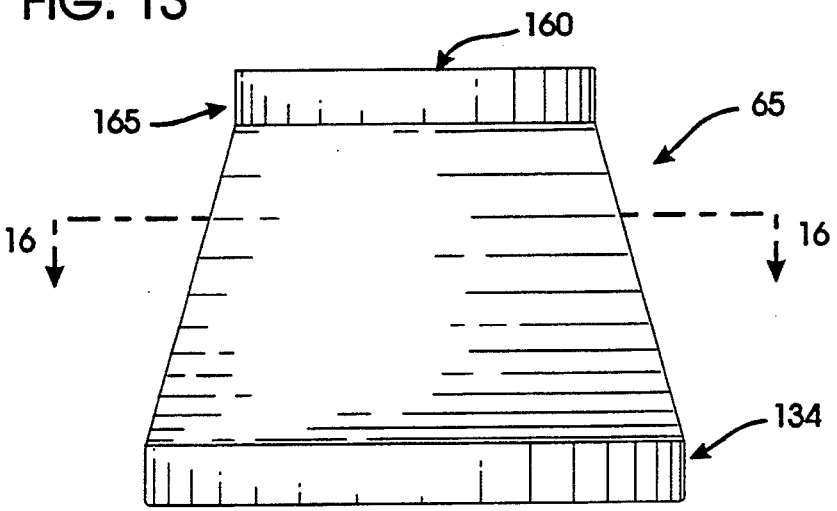
FIG. 13 is a side elevational view of the cone.
Figure 14:
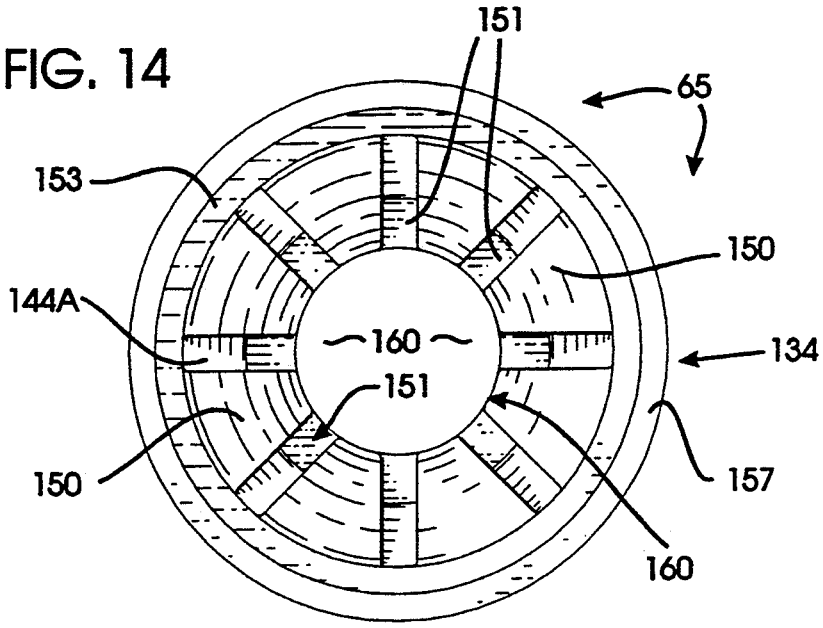
FIG. 14 is a bottom plan view of the cone.

The base 55 is installed at the bottom 85 of an excavation. With primary reference directed to FIGS. 4–6, base unit 55 is generally cylindrical with an open top 87 and a floor surface 89. Reinforcing ribs 88 are defined in the floor 89. Base 55 comprises an inner seamless shell 91 and an integral seamless outer shell 93. Inner shell 91 comprises a peripheral, cylindrical wall 91A surrounding a floor 91B. Outer shell 93 has peripheral wall 93A encircling integral, lower floor 93B. Floor 93B is reinforced by ribs 90 that are complementary to ribs 88 (FIG. 5). Ribs 88 and 90 help resist structural deformations such as ballooning during cavity filling. The shells meet around the upper ledge 95 of the base unit 55. Hence, a continuous generally annular cavity 97 is formed between the inner and outer seamless shells 91, 93. Cavity 97 may be filled with structural or non structural material as necessary. Holes may be drilled in circumferential ledges 95 or 103 for filling with conventional materials. Afterwards the fill-holes are plugged.

The upper peripheral portion of the base 55 forms a spigot 99 (FIG. 5) that mates with the bell of a riser or cone 60 or 65 to form a joint. The spigot 99 comprises an outwardly projecting, peripheral ring 101 formed in the outer wall 93A (FIGS. 4–6, 28, 29). Ring 101 forms a ledge 103 that may structurally support the riser or cone unit 60, 65 above. A lip 105 projects upwardly from the ledge 103. A notch 107 is defined in the lip 105 to support the rubber gasket 132 (FIG. 3). The lip 105 and the inner wall 91A form the upper ledge 95. In assembly, the upwardly projecting lip 105 is inserted into a bell portion 110 of a riser 60 or cone unit 65 disposed above the base.

One or more riser units 60 or 60B (FIG. 3) may be stacked upon the base unit 55. As illustrated in FIGS. 3 and 7–11, the riser units 60, 60B are tubular, seamless and double walled. Riser 60 is longer than riser 60B. Since the risers of different lengths are provided, the system can easily be adapted for different depths. Each riser has an inner and an outer shell 112, 114 respectively. Inner shell 112 comprises a peripheral wall 112A spaced apart from concentric peripheral wall 114A of shell 114, with annular cavity 120 (FIGS. 10–11) formed therebetween. Walls 112A and 114A meet along the top and bottom ledges 116, 118 of the riser 60. Cavity 120 between the walls 112A, 114A may be filled with structural or nonstructural material.

The risers 60, 60B include external rectangular recesses 123 (FIG. 8) formed in radially spaced apart locations in the external periphery of wall 114A. The structural ribs 122 formed between adjacent recesses 123 in the outer walls provide rigidity and prevent torsional flexing. (The ribs 122 of the different stacked risers 60 in FIGS. 1–3 do not necessarily need to be aligned as illustrated.)

The bottom of each riser defines a bell 110 that mates with the upwardly projecting spigot associated with a lower unit, such as base 55 or another riser. The bell 110 comprises an outwardly projecting ledge 124 defined in the inner wall 112A near the bottom of the unit 60 (FIGS. 10, 11, 28, 29). A brim 126 projects downwardly from ledge 124 at a slight angle to facilitate mating with a lower spigot. The cavity 120 is bounded at its bottom by brim 126, ledge 118 and ledge 124. The spigot 99, 128 of the unit below a riser 60 is received within the hollow volume 130 defined by the downwardly projecting brim 126 and the ledge 124. A circular L-shaped gasket 132 (FIG. 3) is placed between the spigot of the base unit 55 and the bell of the riser unit 60 to seal the joint.

The upper portion of a typical riser defines a spigot 128 similar to spigot 99 defined in the upper portion of base 55. The spigot of the riser 128 is intended to mate with the lower bell 110 of another riser unit 60 or a lower bell 134 defined in a cone unit 65. A gasket 132A (FIG. 3) is also disposed between this spigot 128 and the bell of the additional riser or cone unit 99, 134. The riser spigot 128 is formed by an outwardly projecting ring 136 meeting with the upwardly extending inner wall 112A (FIGS. 10, 11, 30, 31). The ring 136 is integral with the ribs 122 and is formed in the outer wall 114A as are the ribs 122. The outwardly projecting ring 136 defines a ledge 138 that can structurally support a riser 60 or cone unit 65. A lip 140 projects upwardly from the ledge. A notch 142 defined in the lip 140 receives the aforementioned gasket 132A. The lip 140 and the inner wall 112A meet to form the upper edge 116 of the riser unit 60.

A preferred cone unit 65 (FIGS. 12–16) is snap fitted to the highest riser 60, 60B or base unit 55. The cone 65 comprises concentric inner and outer seamless shell 144, 146 respectively that define a hollow cavity 148 therebetween. The cone 65 is truncated in shape, and it defines the portion of the manhole often referred to as the corbel. The inner wall 144A of the cone 65 defines evenly spaced, radially spaced apart stiles 150 (FIG. 16) that provide structural integrity to the cone unit 65. Radially spaced apart internal slots 151 border stiles 150. The structure of stiles 150 is illustrated best in FIG. 16. A bell 134 similar to the one formed in the lower portion of a riser unit 110 is defined in the lower portion of the cone 65. The bell 134 mates with the spigot of one of the riser units 128 or the base unit 99.

The bell portion 134 of the cone unit 65 is principally defined by an outwardly projecting ledge 153 formed in the inner wall 144A (FIGS. 12–16, 30, 31). A brim 155 projects downwardly at a slight angle from the ledge 153. This angle facilitates mating with the spigot of a base or riser unit 99, 128. The cavity 148 between the walls 144A, 146A is closed due to the brim 155 and the outer wall 146A meeting to form the lower ledge 157 of the cone unit 65. The bell 134 of the cone unit 65 captivates an L-shaped, circular rubber gasket 132A between the downwardly projecting brim 155 and the upwardly projecting lip 105, 140 of the lower spigot 99, 128. The gasket 132A seals the joint of the spigot 99, 128 and the bell 134.

Figure 15:
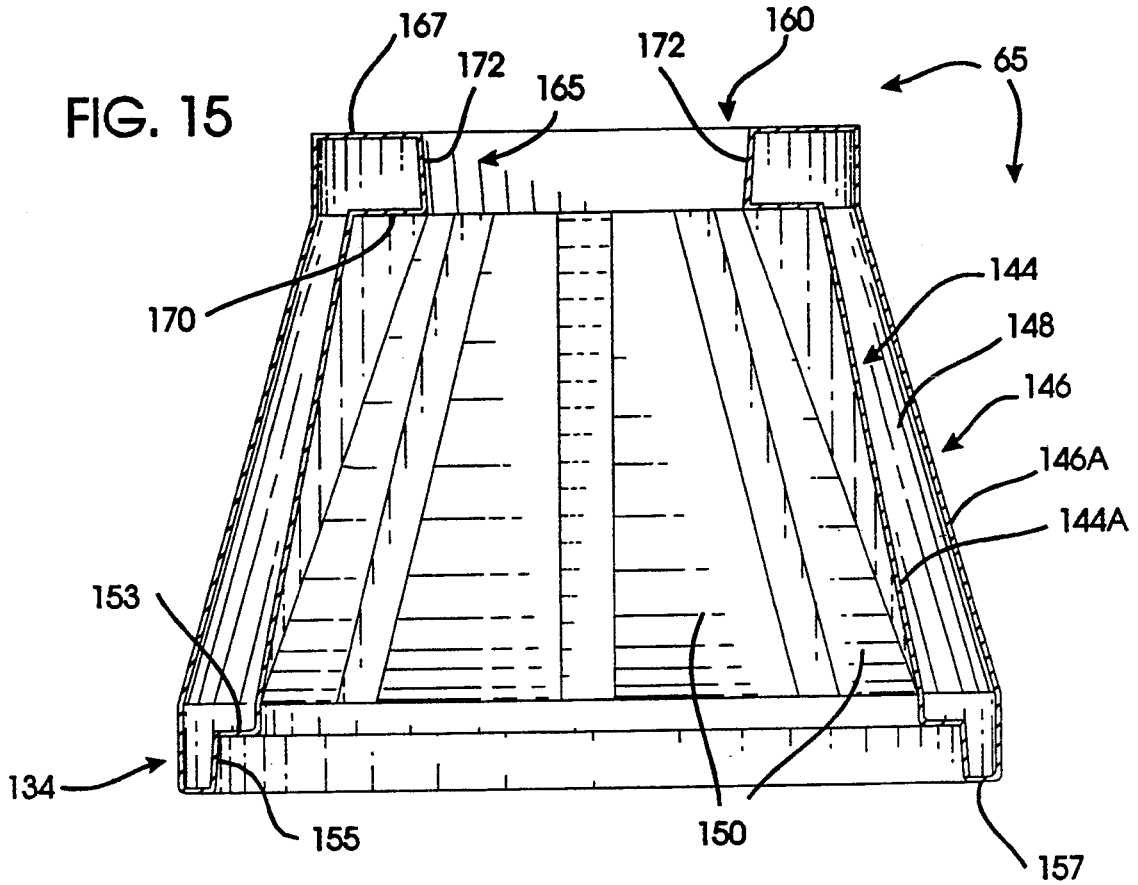
FIG. 15 is an enlarged vertical sectional view of the cone taken generally along line 15—15 of FIG. 12.
Figure 16:
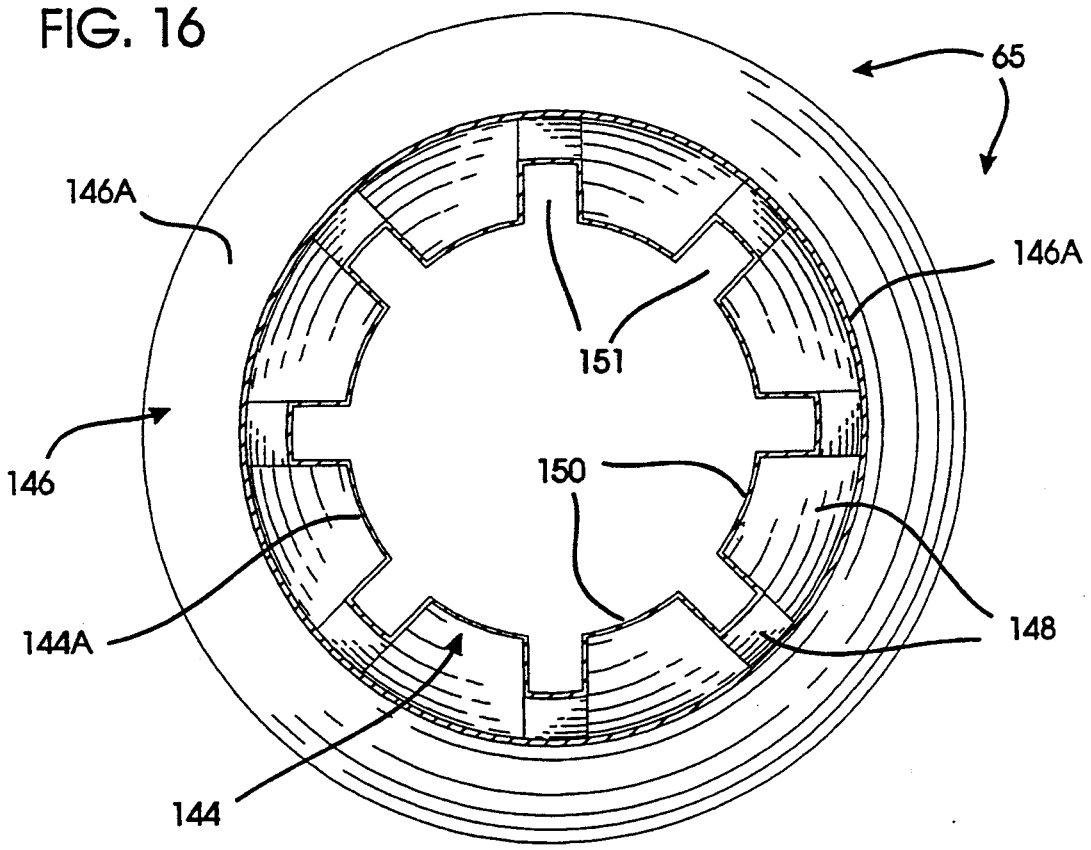
FIG. 16 is an enlarged horizontal sectional view of a cone taken generally along line 16—16 of FIG. 13.
Figure 17:
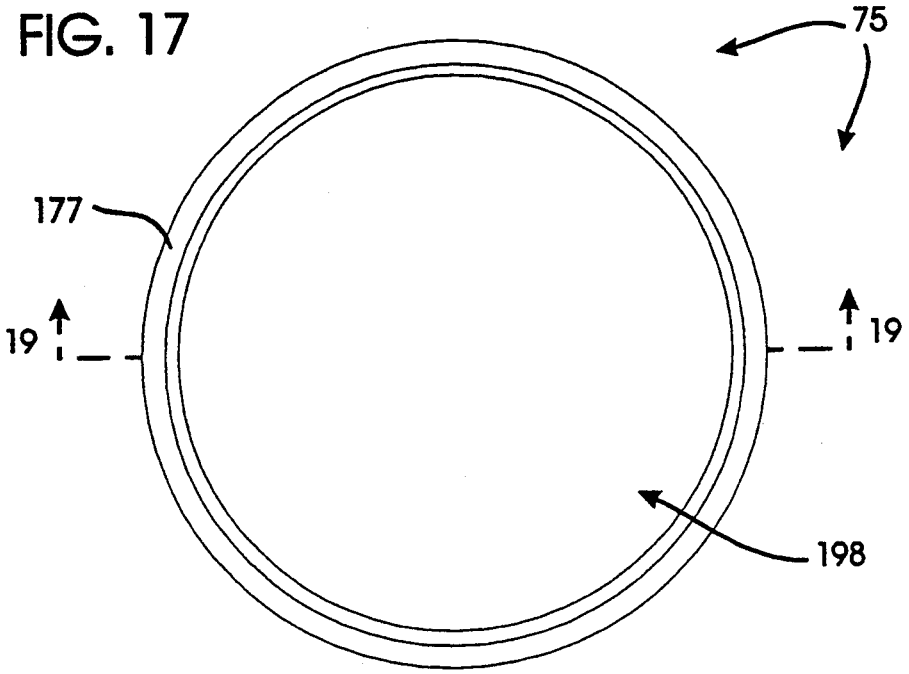
FIG. 17 is a top plan view of a preferred extender.
Figure 18:
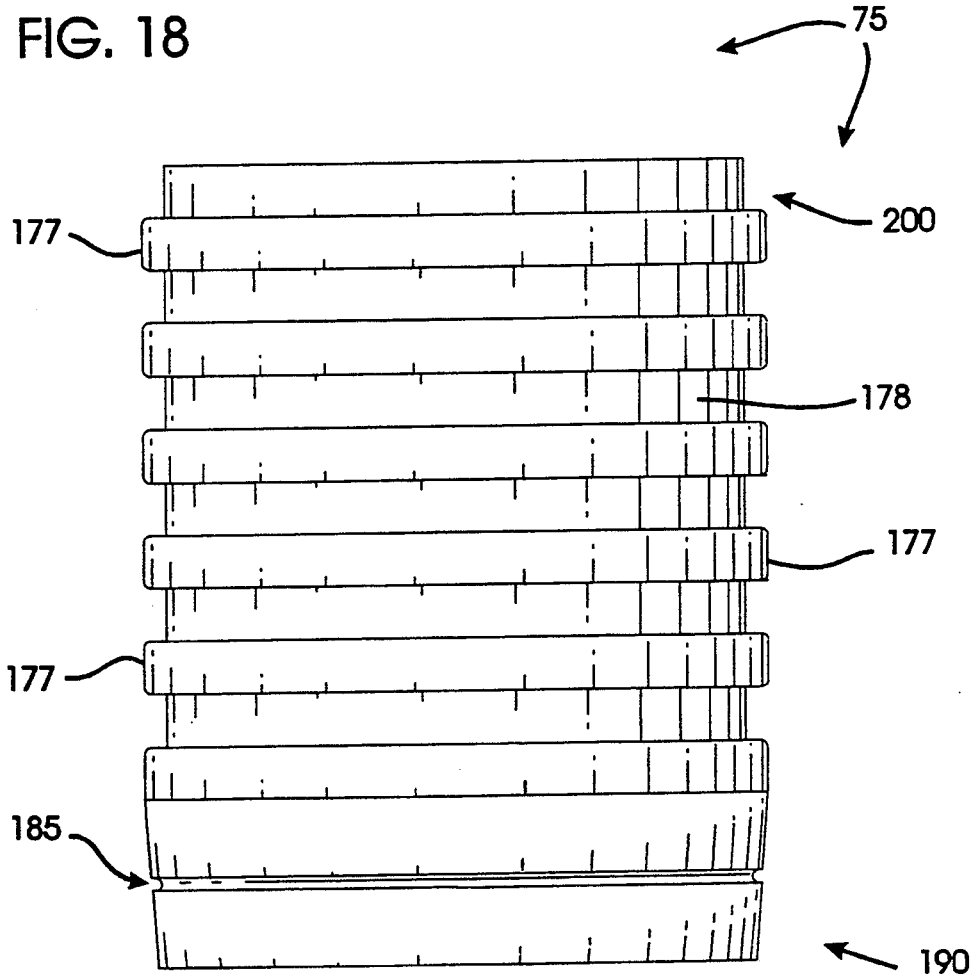
FIG. 18 is a side elevational view of the extender.
Figure 32:
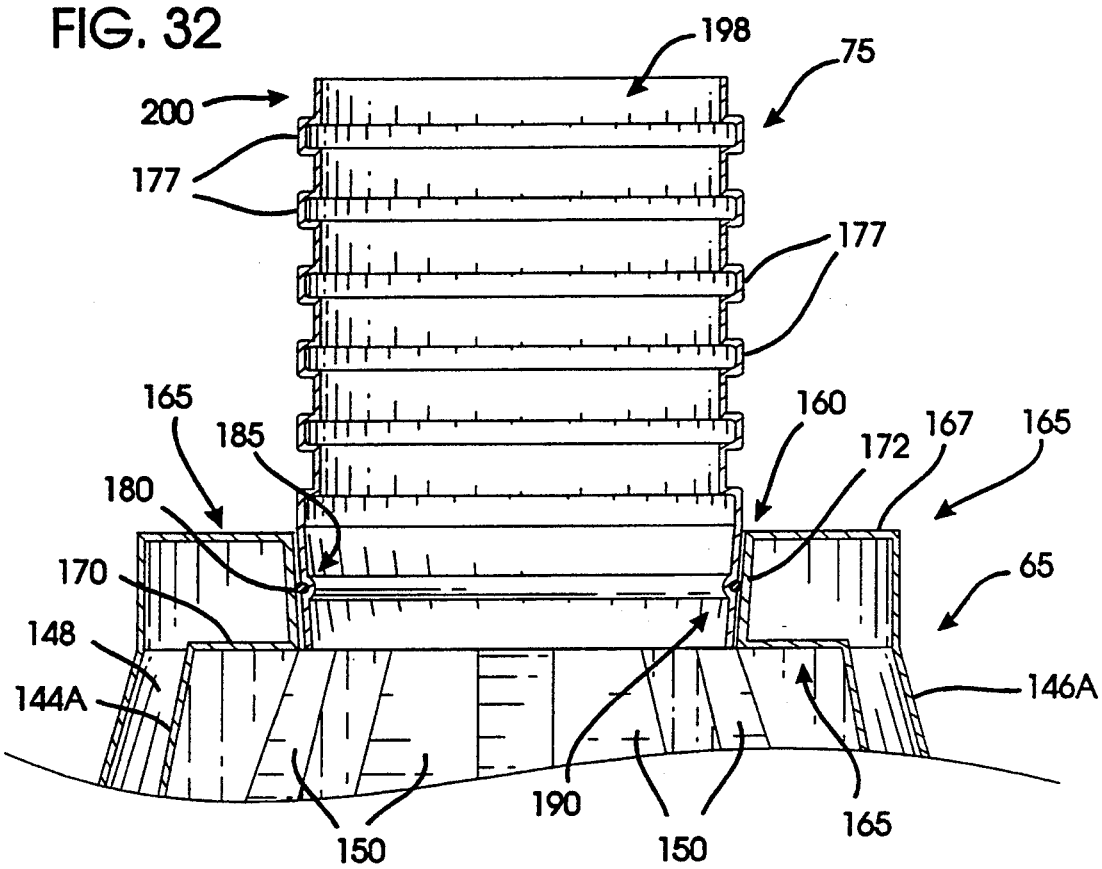
FIG. 32 is an enlarged, fragmentary view illustrating the deployment of an extender in a cone.
Figure 33:
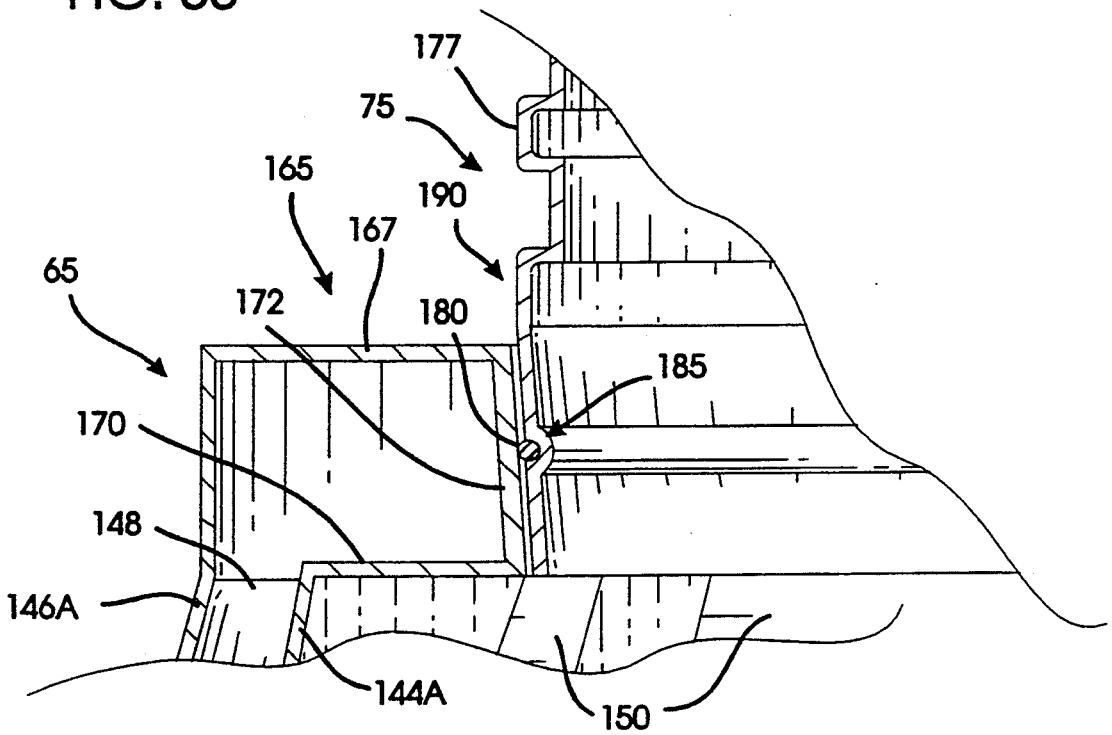
FIG. 33 is a further enlarged fragmentary view of the joint between an extender and a cone.

The upper portion of the cone unit 65 defines a generally circular opening 160 that receives either a manhole cover frame 80 or an extender 75. The generally circular opening 160 is concentric with the manhole units 55, 60, 65 but it is of a gradually reduced diameter. As best illustrated in FIG. 15, the opening 160 is bordered by a peripheral shelf 167 formed by the upper extreme 165 of the cone unit 65 and an inwardly projecting curb 170. The curb 170 and shelf 167 are joined by a slightly angled, generally vertical face 172 that circumscribes opening 160. Hence, the inner border of the circular opening 160 is slightly tapered to facilitate reception and seal of an extender 75, manhole cover frame 80 or manhole cover 175 (FIGS. 32, 33).

Figure 19:
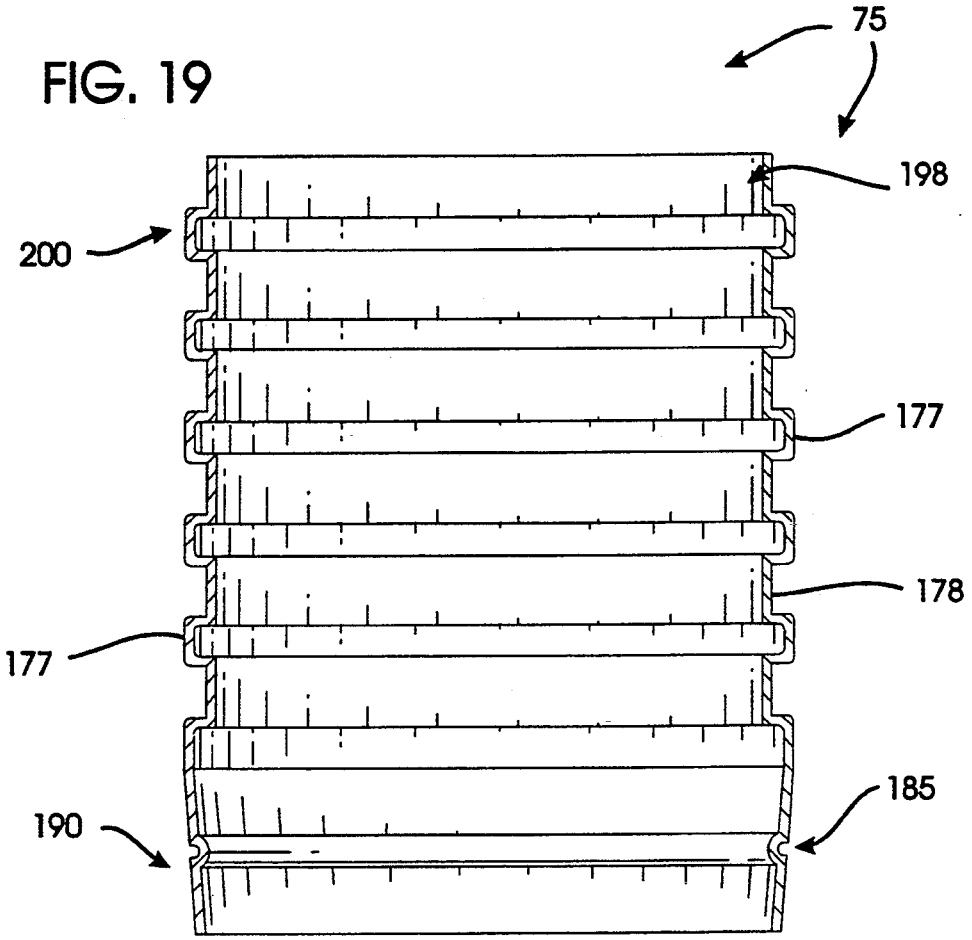
FIG. 19 is a sectional view of an extender taken generally along line 19—19 of FIG. 17.
Figure 20:
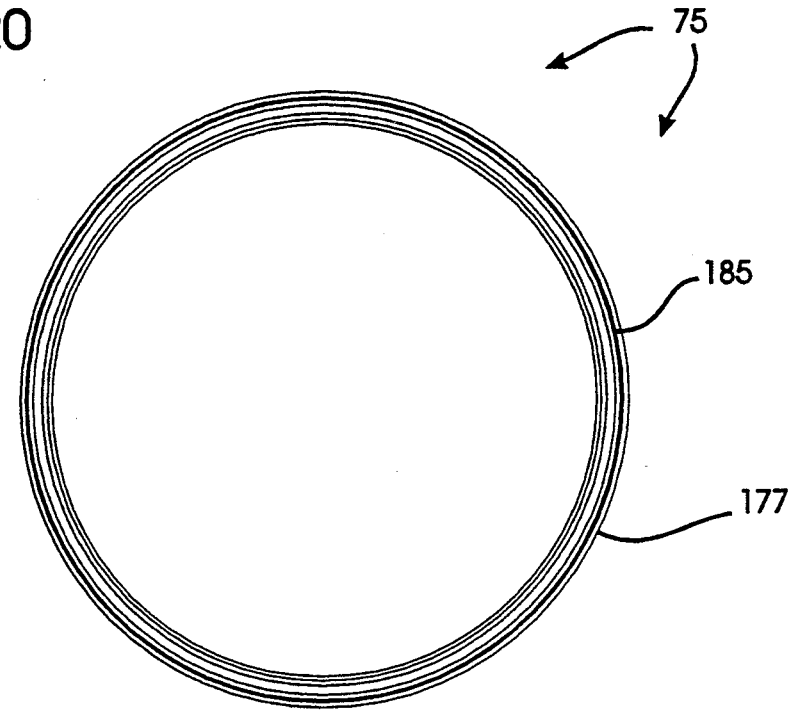
FIG. 20 is a bottom plan view of the preferred extender.
Figure 21:
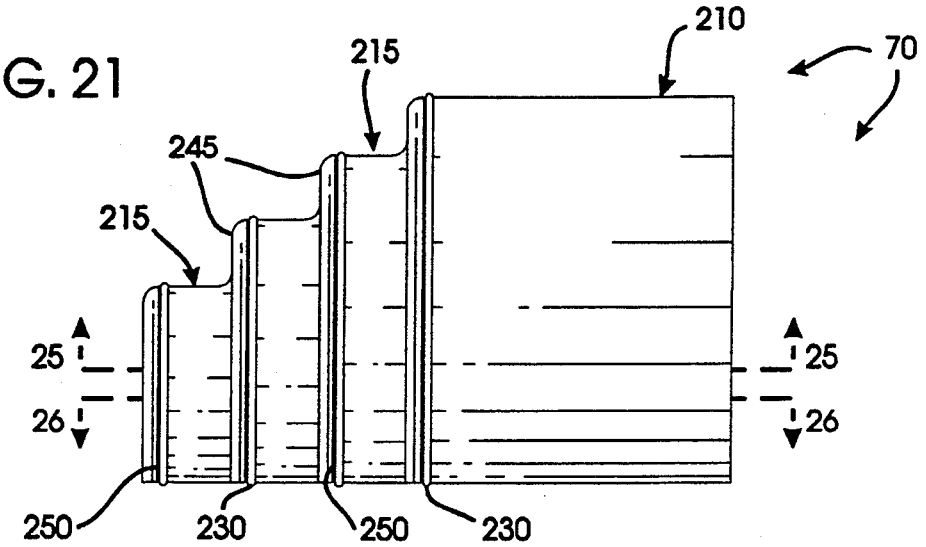
FIG. 21 is a side elevational view of a preferred eccentric reducer.
Figure 22:
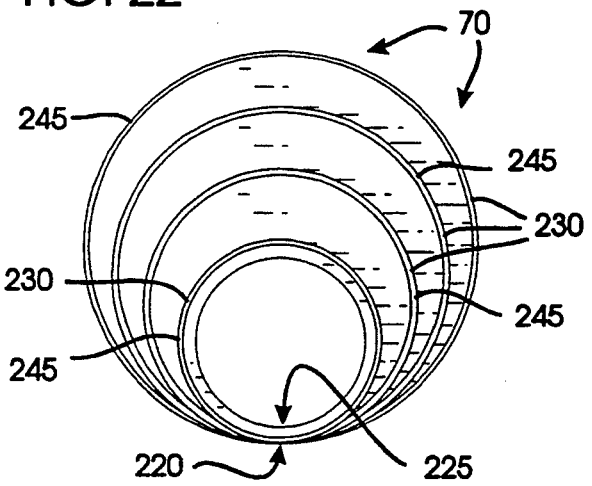
FIG. 22 is a front elevational view of an eccentric reducer taken from a position generally to the left of FIG. 21.
Figure 23:
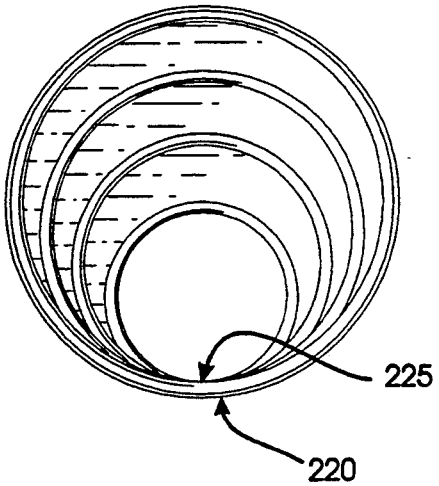
FIG. 23 is a rear elevational view of an eccentric reducer taken from a position generally to the right of FIG. 21.
Figure 24:
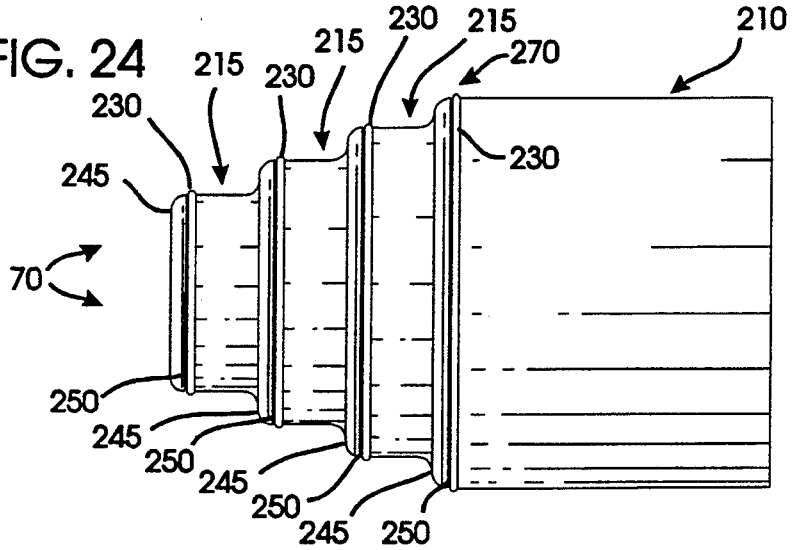
FIG. 24 is a top plan view of the eccentric reducer.
Figure 25:
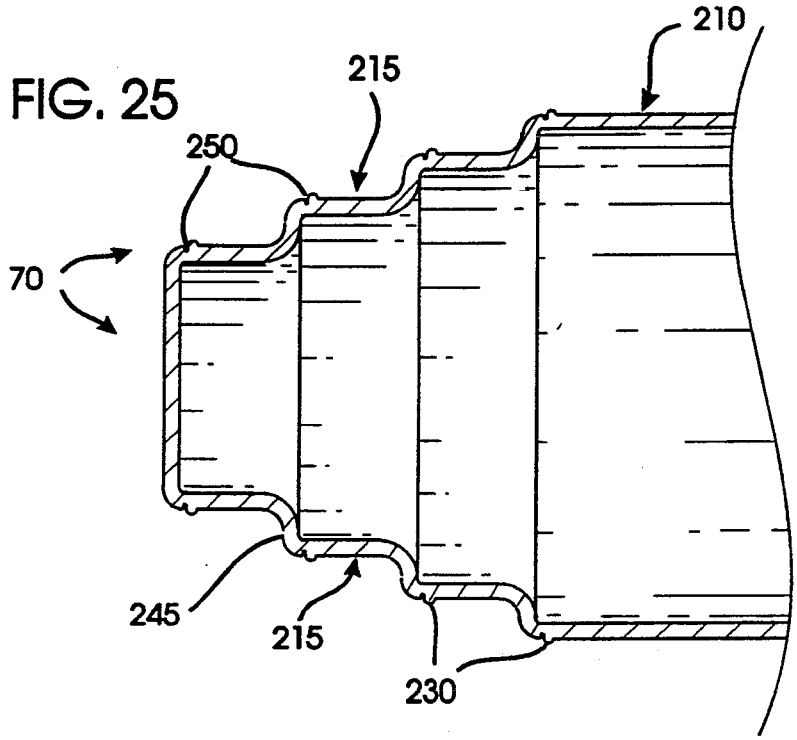
FIG. 25 is a sectional view taken generally along line 25—25 of FIG. 21.
Figure 26:
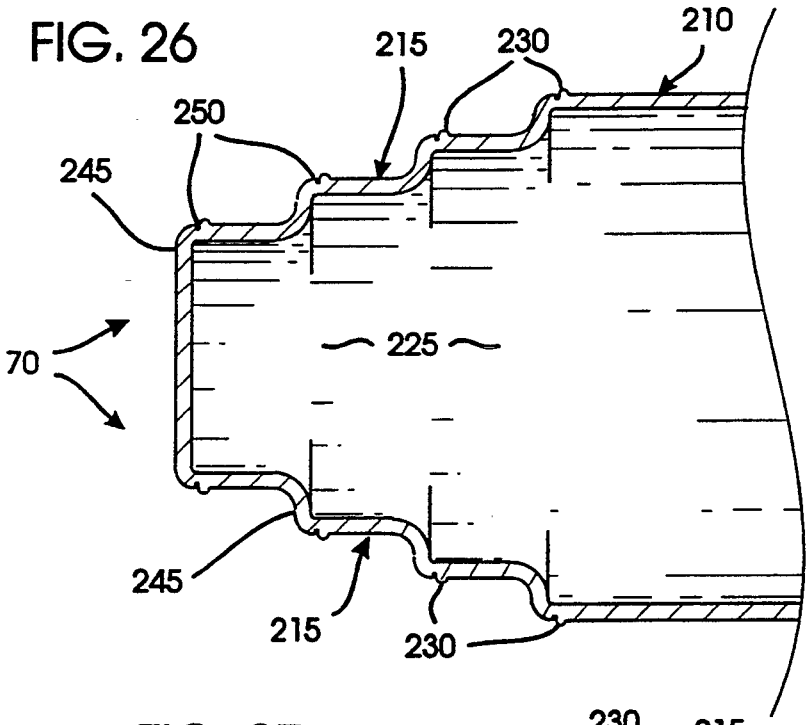
FIG. 26 is a sectional view taken generally along line 26—26 of FIG. 21.
Figure 27:
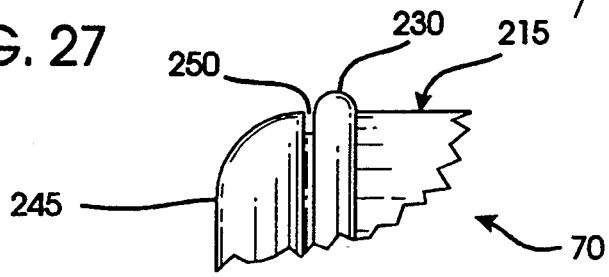
FIG. 27 is an enlarged, fragmentary view of the edge of an eccentric reducer segment illustrating the structural relationship of a ridge and cutting groove.
Figure 28:
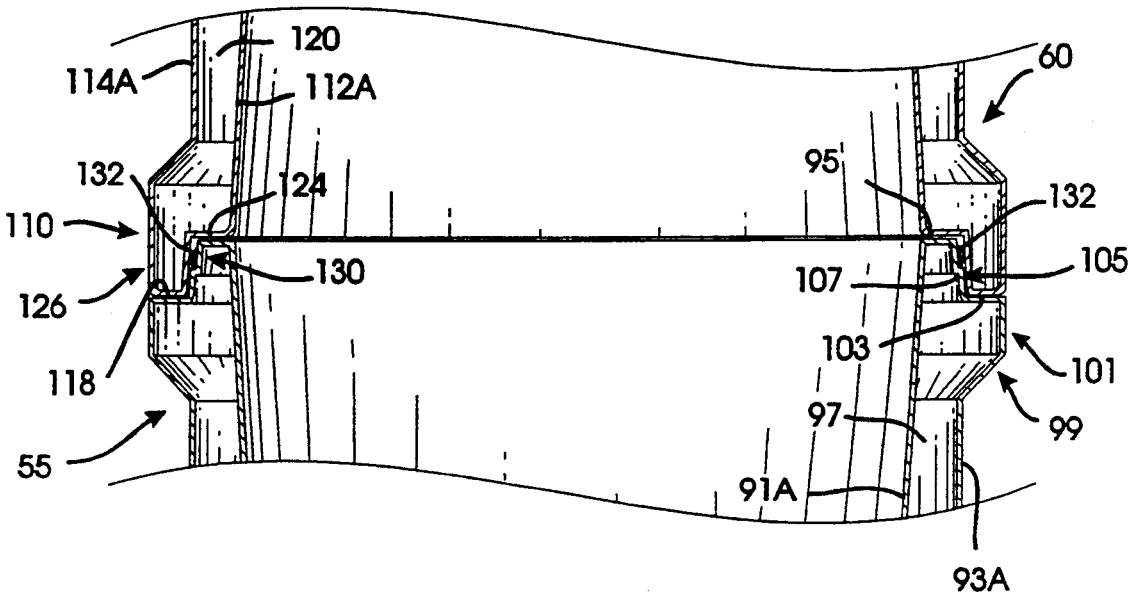
FIG. 28 is an enlarged, fragmentary sectional view illustrating the deployment of a riser upon a base.
Figure 29:
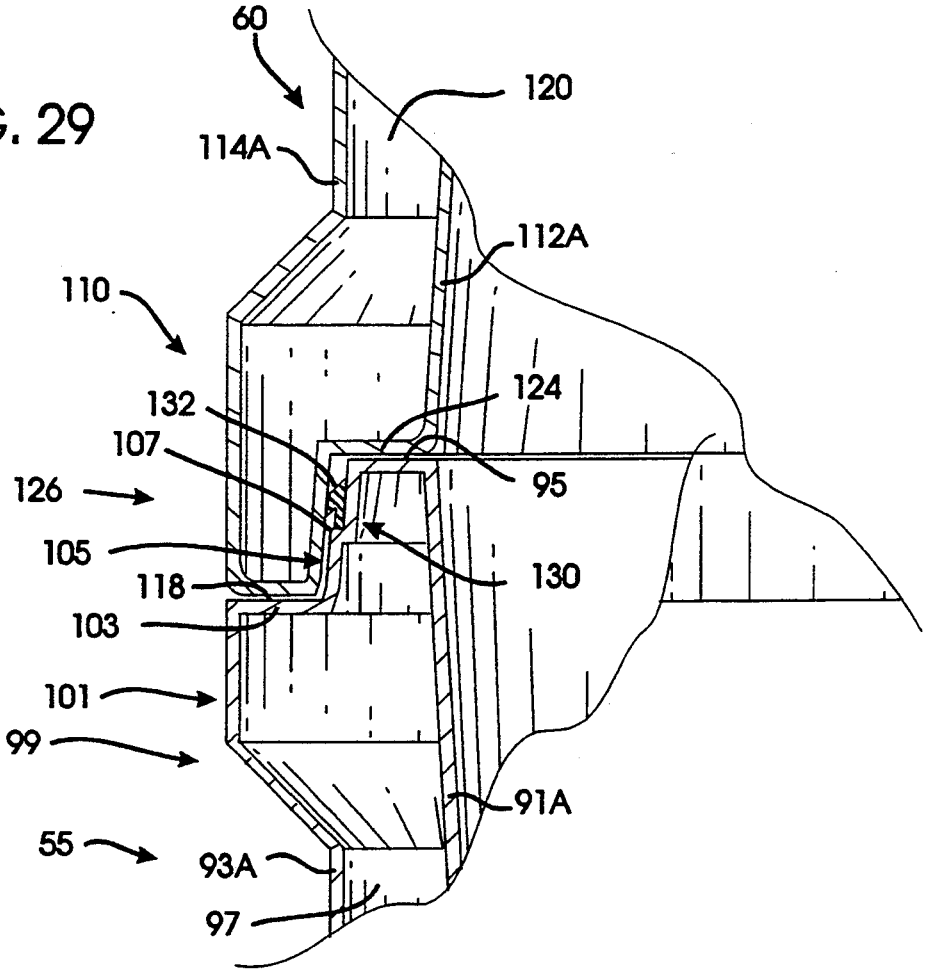
FIG. 29 is an enlarged, fragmentary sectional view of a typical joint formed between a riser and a base.
Figure 30:
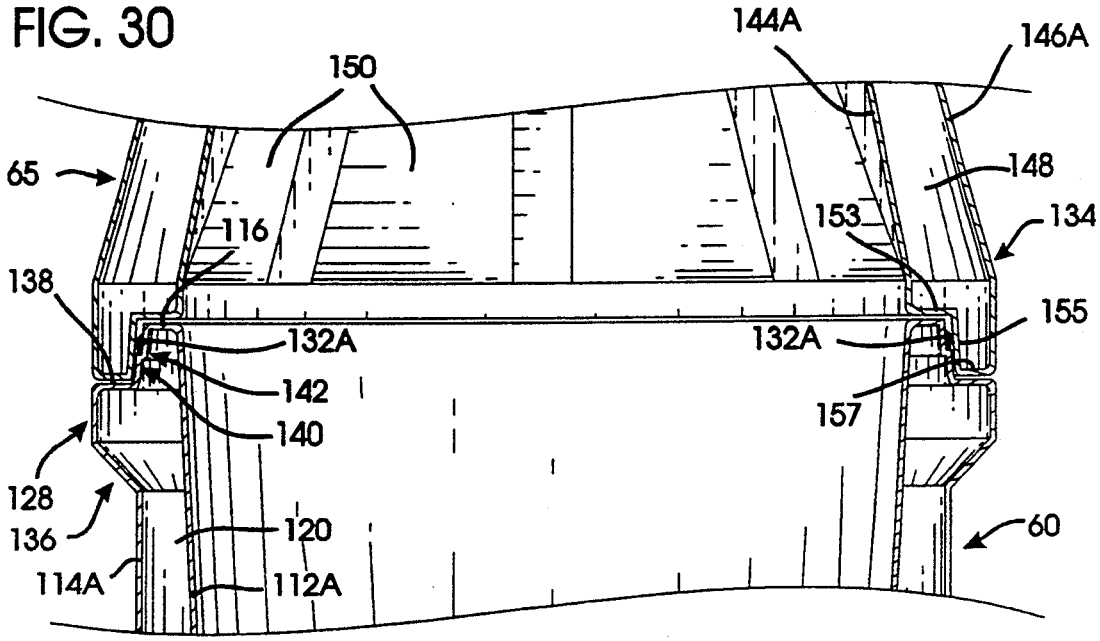
FIG. 30 is an enlarged fragmentary view illustrating the deployment of a cone upon a riser.
Figure 31:
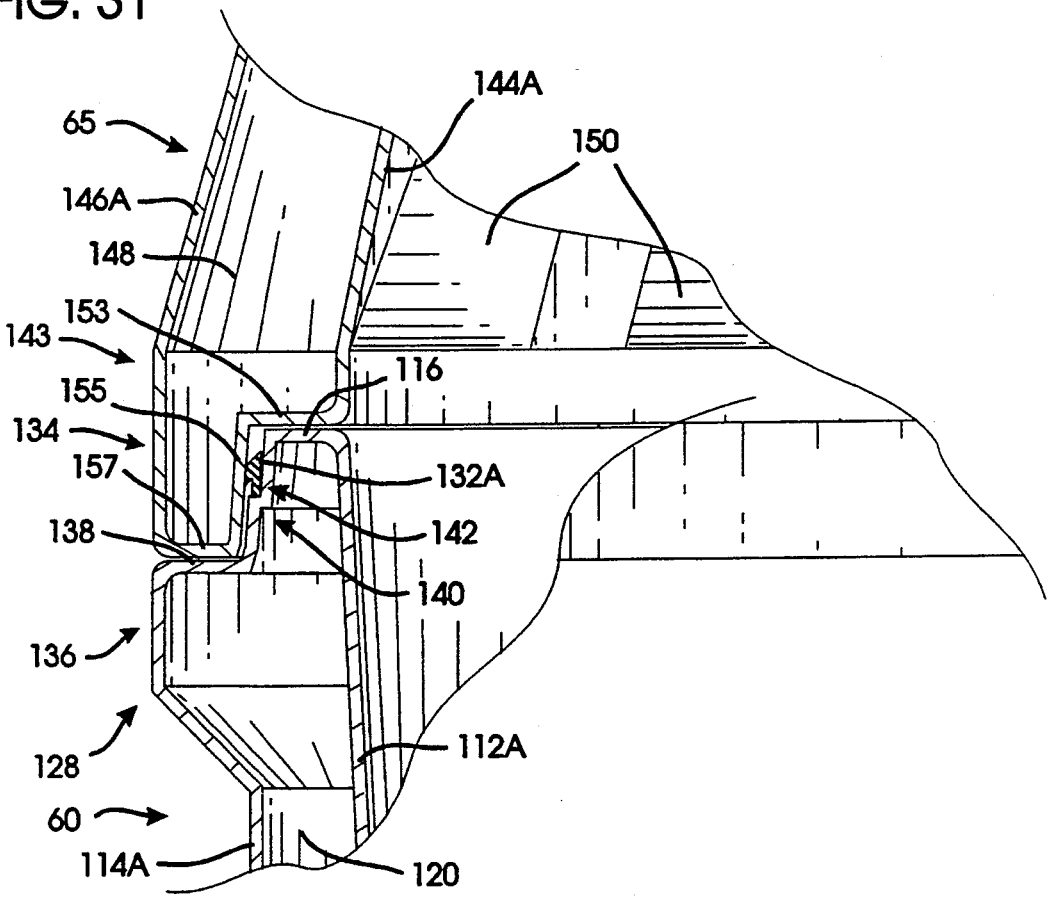
FIG. 31 is a further enlarged fragmentary sectional view of the joint between a cone and a riser.

A typical extender 75 (FIGS. 17–20) is employed to elevate the grade of a manhole made in conformance with the present system 50. In other words it adapts the resultant corbel to the proper height relative to pavement 47 (FIG. 1). Raising the manhole frame 80 optionally associated with the present system 50 may be necessitated by repaving operations or other surface construction that raise the grade in the area of the manhole 50. With attention directed to FIGS. 17 through 20, it will be seen that a preferred extender 75 is tubular, solid, and single walled. Each extender is segmented, so that it may be custom cut to fit the desired system height. Thus each extender defines multiple radial corrugations 177 separated from one another by adjacent, reduced diameter, integral tubular portions 178. The extender mates (i.e., snap fits) with the tapered circular opening 160 in the cone unit 65 (FIGS. 32, 33). The lower stump portion 190 of the extender 75 is tapered to mate with the generally circular upper opening 160 of the cone section 65. A positive seal is formed by rubber gasket 180 (FIG. 3) disposed in a peripheral circular channel 185 (FIG. 19) circumscribing stump 190.

Conventional brick and mortar are conventionally employed to construct an annular reinforcing ring 195 (FIG. 1). Ring 195 is erected around the outer periphery of the extender 75 to facilitate structural support in compliance with local building codes. Additionally, this brick and mortar structure 195 may be supported by the upper shelf 167 in cone unit 65. The newly elevated opening 198 in the upper portion 200 of the extender 75 will mount the manhole frame 80.

The eccentric reducer couplings 70 that interface the manhole system 50 with sewer lines 72 (FIG. 1) have a tubular, single wall body 210. The body 210 is intended to be inserted into a hole 255 (FIG. 3) cut through the walls 91A, 93A of the base unit 55 at a level appropriate to facilitate sewage flow. As illustrated in FIGS. 21 through 27, the eccentric reducer 70 further comprises multiple hollow, cylindrical, eccentric segments 215. The segments 215 are sized to mate with various sizes of conventional sewer pipe 72. Each segment 215 is tubular and shares a tangency point 220 (FIG. 22) along its diameter with the other segments 215, thereby providing a smooth bottom 225 to facilitate sewage flow. Each eccentric segment 215 defines a ridge 230 near the end opposite the tubular body 210. This ridge 230 facilitates attachment of a flexible pipe coupling 235 (FIG. 1).

The preferred pipe couplings 235 (FIG. 1) comprise a rubber sleeve 240 with a circular clamp 242 on each end of the sleeve 240. Between the ridge 230 and the edge 245 of the eccentric segment 215 is a cutting groove 250, depicted in detail in FIG. 27. This groove 250 acts as a guide to aid in cutting the eccentric reducer 70 off to eliminate the eccentric segments 215 that are smaller than the sewer pipe 72 to which it is mated. Polyethylene welding is preferably employed to seal the tubular body 210 of the eccentric reducer 70 in place through the walls of the base unit 55.

Figure 34:
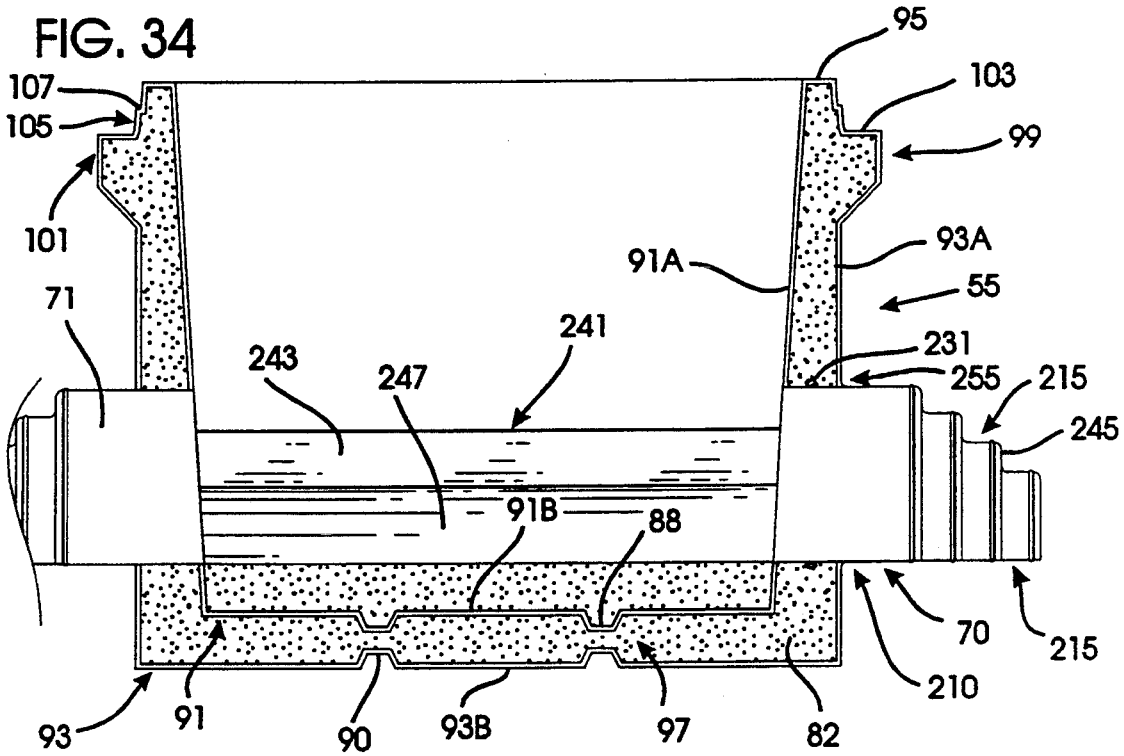
FIG. 34 is a partially fragmentary sectional view of the base with a deployed eccentric reducer; and, FIG. 35 is an enlarged, fragmentary sectional view further illustrating the reducer connection to the base.
Figure 35:
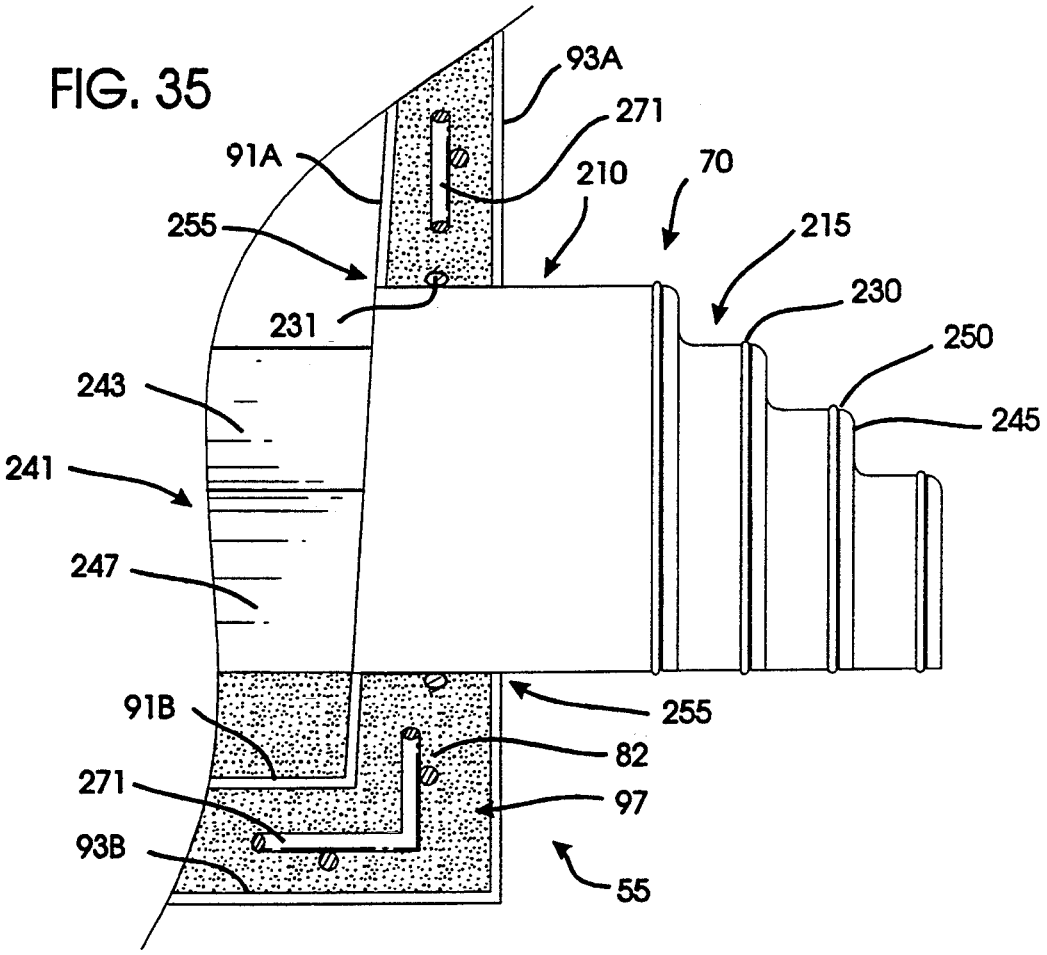

Turning to FIGS. 34 and 35, a hole 255 smaller than the outer diameter of the eccentric reducer's tubular body 210 is cut in the base unit 55. The area around the hole 255 is heated, softening the plastic of which the base unit 55 is constructed. The reducer segments 215 are then inserted into the heated hole 255 from inside the base unit 55 as polyethylene welding continues. The tubular body portion 210 is heated and pressed into place, sealing the reducer 70 with O-ring 231. To obtain a satisfactory seal, the plastic of the base unit walls 91A, 93A and the plastic of the tubular body 70 are preferably heat welded together or glued. Regardless, subsequent filling of the base unit 55 with structural material such as cement or small aggregate concrete 82 will help complete the seal.

The preferred method for sealing the tubular body 210 within the walls 91A, 93A of the base unit 55 includes an O-ring seal 231 about the periphery of the tubular body 210 (FIG. 35). Once again the use of structural fill material 82 completes the installation. Additionally, sealants such as silicone caulking, polyethylene resin based plastic glue, or grout may be employed to facilitate sealing the installation regardless of the method used.

The concrete invert 241 is installed within the base after the reducers are fitted. It includes the conventional bench portions 243 about the sides of conventional flow channel 247. The invert forms a sewage flow pathway with its channel 247 that is substantially aligned with reducer couplings 70, 71 (FIG. 34).

For reinforcement purposes, it should be understood that with each of the aforedescribed modular units, structural steel reinforcement 271 (FIG. 35), of a generally tubular configuration, can be enclosed within a cavity 97 between the double walls of the base to provide additional strength if required by the user. Although rebar is illustrated in the base unit, it may be employed in any or all of the modular units. The optional rebar will be inserted during the rotational molding process.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A modular, plastic manhole comprising a plurality of separate, independent, electrically non-conductive units custom installed and permanently configured within an appropriate excavation at a job site proximate an undergound sewer line, said manhole vertically extending between a bottom of the excavation adjacent the sewer line and a surface thereabove, said manhole comprising:

a leakproof, corrosion resistant base disposed upon said bottom, said base comprising integral, spaced apart, generally coaxial inner and outer shells, each of said shells comprising a cylindrical wall and a floor intersecting said wall, said inner and outer shells defining an annular cavity therebetween for receiving a desired amount of filler;

corrosion resistant, electrically non-conductive segmented reducer means for flexibly coupling said base to said sewer line;

at least one leakproof, corrosion resistant, electrically non-conductive riser snap fitted to said base to form a flexible leakproof juncture therebetween, each riser comprising integral inner and outer shells defining an annular cavity therebetween adapted to receive a desired amount of filler, said last mentioned annular cavity separate from said base annular cavity; and, a leakproof, corrosion resistant cone snap fitted to a riser to form a flexible leakproof juncture therebetween, said cone extending vertically upwardly towards said surface and comprising integral, inner and outer, generally coaxial spaced apart shells defining an annular cavity therebetween adapted to receive a desired amount of filler.

2. The manhole as defined in claim 1 further comprising a generally tubular, segmented, plastic extender fastened vertically on top of said cone and flushly extending to said surface.

3. The manhole as defined in claim 1 wherein said reducer means comprises a plurality of integral, eccentric, tubular segments defining successively smaller diameters.

4. The manhole as defined in claim 3 wherein said reducer means comprises:

a groove formed in each of said eccentric segments enabling the cutting of said reducer means to eliminate segments of a diameter less than desired; and, a rib formed in each of said eccentric segments between said groove and the next larger eccentric segment to expedite the joining of said reducer means to said sewer line.

5. A plastic, non-conductive modular manhole comprising:

a corrosion resistant, molded, leakproof base disposed within the ground at the bottom of the manhole adjacent a subterranean sewer line, said base comprising integral, spaced apart, generally coaxial inner and outer shells, said inner and outer shells defining an annular cavity therebetween for receiving filler, said base having a bottom floor, an open top, and an upwardly projecting spigot;

a corrosion resistant, molded, leakproof cone at the top of the manhole comprising integral, inner and outer generally coaxial, spaced apart shells defining an annular cavity therebetween for receiving filler, said cone comprising a bell for flexibly mating with a spigot;

a flexible riser section stacked to said base and extending vertically upwardly therefrom, said riser section comprising at least one uniform diameter corrosion resistant, molded leakproof riser disposed between said base and said cone, each riser comprising integral inner and outer shells defining an annular cavity therebetween for filler, and each riser further comprising an upper spigot mated to a bell above it and a lower bell flexibly mated with a spigot of a riser or base disposed immediately beneath it;

a reducer coupled to said base for flexibly coupling said manhole to a sewer line, said reducer comprising integral, tubular segments defining successively smaller diameters; and, a generally tubular, user-adjustable segmented extender extending vertically upwardly from said cone to a manhole frame.

6. The manhole as defined in claim 5 wherein said reducer comprises a groove formed in each of said segments to facilitate the cutting of said reducer to eliminate segments of a diameter less than desired, and a rib formed in each of said eccentric portions between said groove and the next larger segment enabling the mating connection of said reducer to said sewer pipe.

* * * * *